US010201992B2

(12) United States Patent
Ito et al.

(10) Patent No.: US 10,201,992 B2
(45) Date of Patent: Feb. 12, 2019

(54) IMAGE RECORDING APPARATUS PROVIDED WITH FIRST AND SECOND CONVEYING ROLLERS AND FIRST AND SECOND MOTORS

(71) Applicant: BROTHER KOGYO KABUSHIKI KAISHA, Nagoya (JP)

(72) Inventors: Tsuyoshi Ito, Nagoya (JP); Masao Mimoto, Nagoya (JP); Aya Kimura, Yokohama (JP); Iwane Sano, Obu (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/939,616

(22) Filed: Mar. 29, 2018

(65) Prior Publication Data

US 2018/0281479 A1 Oct. 4, 2018

(30) Foreign Application Priority Data

Mar. 31, 2017 (JP) ..... 2017-070195

(51) Int. Cl.

| | |
|---|---|
| ***B41J 13/00*** | (2006.01) |
| ***B41J 13/02*** | (2006.01) |
| ***B41J 3/60*** | (2006.01) |
| *B41J 11/00* | (2006.01) |

(52) U.S. Cl.

CPC ..... *B41J 13/0009* (2013.01); *B41J 3/60* (2013.01); *B41J 13/02* (2013.01); *B41J 11/0095* (2013.01)

(58) Field of Classification Search

CPC ..... B41J 13/0009; B41J 3/60; B41J 13/02; B41J 11/0095

See application file for complete search history.

(56) References Cited

U.S. PATENT DOCUMENTS

2011/0285076 A1* 11/2011 Fujiwara ..... B65H 29/52 271/186

FOREIGN PATENT DOCUMENTS

| | | |
|---|---|---|
| JP | 2000-47436 A | 2/2000 |
| JP | 2014-61984 A | 4/2014 |

* cited by examiner

*Primary Examiner* — Yaovi M Ameh
(74) *Attorney, Agent, or Firm* — Merchant & Gould P.C.

(57) ABSTRACT

An image recording apparatus includes first and second conveying passages, a recording portion for recording images, first and second conveying rollers, first and second motors, a power transmission mechanism switchable between a first state and a second state, and a controller. In the first state of the mechanism, the controller drives the first motor to rotate the first and second conveying rollers, thereby conveying a recording medium along the first conveying passage in a first conveying direction. During this conveyance, the controller controls the recording portion to record an image on one surface of the recording medium. Then, the controller switches the mechanism from the first state to the second state, and drives the second motor in the second state of the mechanism to rotate the second conveying roller independently of the first conveying roller, thereby conveying the recording medium along the second conveying passage in a second conveying direction.

10 Claims, 20 Drawing Sheets

IMAGE RECORDING APPARATUS PROVIDED WITH FIRST AND SECOND CONVEYING ROLLERS AND FIRST AND SECOND MOTORS

CROSS REFERENCE TO RELATED APPLICATION

This application claims priority from Japanese Patent Application No. 2017-070195 filed Mar. 31, 2017. The entire content of the priority application is incorporated herein by reference.

TECHNICAL FIELD

The present disclosure relates to an image recording apparatus for recording an image on a recording medium.

BACKGROUND

Japanese Patent Application Publication No. 2014-61984 discloses an image recording apparatus that can record an image on each side of a recording medium such as a recording sheet. According to the disclosed apparatus, after a recording sheet is supplied from a sheet supply tray, an image is recorded on a front surface of the recording sheet by a recording portion while the recording sheet is conveyed in a conveying direction by a first conveying roller. The recording sheet on which the image has been recorded is then conveyed to a second conveying roller positioned downstream of the recording portion in the conveying direction. The second conveying roller, with its rotation in a forward direction, conveys the recording sheet to a discharge tray. Further, the second conveying roller, with its rotation in a reverse direction, can convey the recording sheet to a reverse conveying passage through a branch opening formed between the recording portion and the second conveying roller. The recording sheet that has been conveyed to the reverse conveying passage is conveyed to a portion upstream of the recording portion in the conveying direction. Subsequently, in a manner the same as the image recording on the front surface, an image is recorded on a back surface of the recording sheet while the same is conveyed by the first conveying roller. The recording sheet subjected to double-sided recording (i.e., double-sided printing) is then discharged to the discharge tray by the second conveying roller.

Further, it has been known in the art that a "simultaneous process" is performed in a conventional image recording apparatus. That is, in a case where the conventional apparatus performs double-sided recording to a plurality of recording sheets, the conventional apparatus conveys a preceding sheet in which an image has been recorded on a front surface to the reverse conveying passage by the second conveying roller while conveying a subsequent recording sheet in the conveying direction by the first conveying roller. With such simultaneous process, conveyance of the preceding sheet to the reverse conveying passage by the second conveying roller and conveyance of the subsequent sheet by the first conveying roller can be simultaneously performed. Accordingly, double-sided recording can be performed at high speed.

SUMMARY

In the image recording apparatus disclosed in the Japanese Patent Application Publication No. 2014-61984, a driving power of a single drive motor is transmitted to both the first and second conveying rollers, thereby causing the two rollers to rotate. This configuration may restrict drive timing of the single drive motor when attempting to perform the simultaneous process. Accordingly, in the simultaneous process performed by the conventional apparatus, speeding up of double-sided recording cannot be achievable to the maximum.

In order to overcome the above-described drawback, it is conceivable that a drive motor is provided exclusively for the second conveying roller so that the second conveying roller can be driven independently of the rotation of the first conveying roller. In this case, however, the following problem may be invoked.

That is, in a case where the first and second conveying rollers are driven by two separate drive motors, difference in rotation speed between the two drive motors may occur due to aged degradation thereof. Accordingly, when the two separate drive motors convey the recording sheet in cooperation with each other, conveying amount by the first conveying roller may differ from that by the second conveying roller. As a result, a predetermined conveying amount required for the image recording by the recording portion may not be obtained. This may cause disturbance of the image recorded on the recording sheet.

In view of the foregoing, it is an object of the disclosure to provide an image recording apparatus that can maximally speed up the double-sided recording while suppressing disturbance of the image to be recorded on the recording medium such as the recording sheet.

In order to attain the above and other objects, according to one aspect, the disclosure provides an image recording apparatus including a first conveying passage, a second conveying passage, a recording portion, a first conveying roller, a second conveying roller, a first motor, a second motor, a power transmission mechanism, a detecting portion, and a controller. A first recording medium and a second recording medium are configured to be conveyed along the first conveying passage in a first conveying direction. The recording portion is provided at the first conveying passage. The recording portion is configured to record an image on each of the first recording medium and the second recording medium. The second conveying passage is branched from the first conveying passage at a branching portion and joins the first conveying passage at a joining portion. The branching portion is positioned downstream of the recording portion in the first conveying direction. The joining portion is positioned upstream of the recording portion in the first conveying direction. The first recording medium and the second recording medium are configured to be conveyed along the second conveying passage in a second conveying direction from the branching portion toward the joining portion. The first conveying roller is provided at the first conveying passage and positioned downstream of the joining portion in the first conveying direction. The second conveying roller is provided at the first conveying passage and is positioned downstream of the branching portion in the first conveying direction. The first motor is configured to provide a first driving force. The second motor is configured to provide a second driving force. The power transmission mechanism is capable of being switched between a first state and a second state. The power transmission mechanism in the first state is configured to transmit the first driving force to both the first conveying roller and the second conveying roller. The power transmission mechanism in the second state is configured to transmit the first driving force to the first conveying roller and to transmit the second driving force to the second conveying roller. The detecting portion is configured to detect a position of each of the first recording medium and the second recording medium. The controller is capable of controlling the recording portion, the first motor, the second motor, the power transmission mechanism, a conveyance of the first recording medium, and a conveyance of the second recording medium. The controller is configured to perform: (a) conveying the first recording medium along the first conveying passage in the first conveying direction by (s1) rotating the first conveying roller and the second conveying roller, the (s1) rotating being performed by driving the first motor in the first state of the power transmission mechanism; while performing the (a) conveying, (b) recording an image on one surface of the first recording medium using the recording portion; after completion of the (b) recording, (c) determining using the detecting portion whether an upstream end of the first recording medium in the first conveying direction has been moved to the branching portion by the (a) conveying; in response to determining, in the (c) determining, that the upstream end of the first recording medium in the first conveying direction has been moved to the branching portion by the (a) conveying, (d) switching the power transmission mechanism from the first state to the second state; after the (d) switching, (e) conveying the first recording medium along the second conveying passage in the second conveying direction by (s2) rotating the second conveying roller, the (s2) rotating being performed by driving the second motor in the second state of the power transmission mechanism; while performing the (e) conveying, (f) conveying the second recording medium along the first conveying passage in the first conveying direction by (s3) rotating the first conveying roller, the (s3) rotating being performed by driving the first motor in the second state of the power transmission mechanism; after starting the (f) conveying, (g) recording an image on one surface of the second recording medium using the recording portion; and after completion of the (g) recording, (h) conveying the second recording medium along the second conveying passage in the second conveying direction.

According to another aspect, the disclosure provides an image recording apparatus including: a first conveying passage, a second conveying passage, a recording portion, a first conveying roller, a second conveying roller, a first motor, a second motor, a power transmission mechanism, a detecting portion, and a controller. A first recording medium and a second recording medium are configured to be conveyed along the first conveying passage in a first conveying direction. The recording portion is provided at the first conveying passage. The recording portion is configured to record an image on each of the first recording medium and the second recording medium. The second conveying passage is branched from the first conveying passage at a branching portion and joins the first conveying passage at a joining portion. The branching portion is positioned downstream of the recording portion in the first conveying direction. The joining portion is positioned upstream of the recording portion in the first conveying direction. The first recording medium and the second recording medium are configured to be conveyed along the second conveying passage in a second conveying direction from the branching portion toward the joining portion. The first conveying roller is provided at the first conveying passage and is positioned downstream of the joining portion in the first conveying direction. The second conveying roller is provided at the first conveying passage and positioned downstream of the branching portion in the first conveying direction. The first motor is configured to provide a first driving force. The second motor is configured to provide a second driving force. The power transmission mechanism is capable of being switched between a first state and a second state. The power transmission mechanism in the first state is configured to transmit the first driving force to both the first conveying roller and the second conveying roller. The power transmission mechanism in the second state is configured to transmit the first driving force to the first conveying roller and to transmit the second driving force to the second conveying roller. The detecting portion is configured to detect a position of each of the first recording medium and the second recording medium. The controller is capable of controlling the recording portion, the first motor, the second motor, and the power transmission mechanism. The controller is configured to perform: (a) driving the first motor in the first state of the power transmission mechanism to rotate the first conveying roller and the second conveying roller, thereby conveying the first recording medium along the first conveying passage in the first conveying direction; while performing the (a) driving, (b) recording an image on one surface of the first recording medium using the recording portion; after completion of the (b) recording, (c) determining using the detecting portion whether an upstream end of the first recording medium in the first conveying direction has been moved to the branching portion by the (a) driving; in response to determining, in the (c) determining, that the upstream end has been moved to the branching portion by the (a) driving, (d) switching the power transmission mechanism from the first state to the second state; after the (d) switching, (e) driving the second motor in the second state of the power transmission mechanism to rotate the second conveying roller, thereby conveying the first recording medium along the second conveying passage in the second conveying direction; while performing the (e) driving, (f) driving the first motor in the second state of the power transmission mechanism to rotate the first conveying roller, thereby conveying the second recording medium along the first conveying passage in the first conveying direction; after starting the (f) driving, (g) recording an image on one surface of the second recording medium using the recording portion; and after completion of the (g) recording, (h) driving the second motor in the second state of the power transmission mechanism to rotate the second conveying roller, thereby conveying the second recording medium along the second conveying passage in the second conveying direction.

BRIEF DESCRIPTION OF THE DRAWINGS

The particular features and advantages of the embodiment(s) as well as other objects will become apparent from the following description taken in connection with the accompanying drawings, in which.

DETAILED DESCRIPTION

Figure 1:
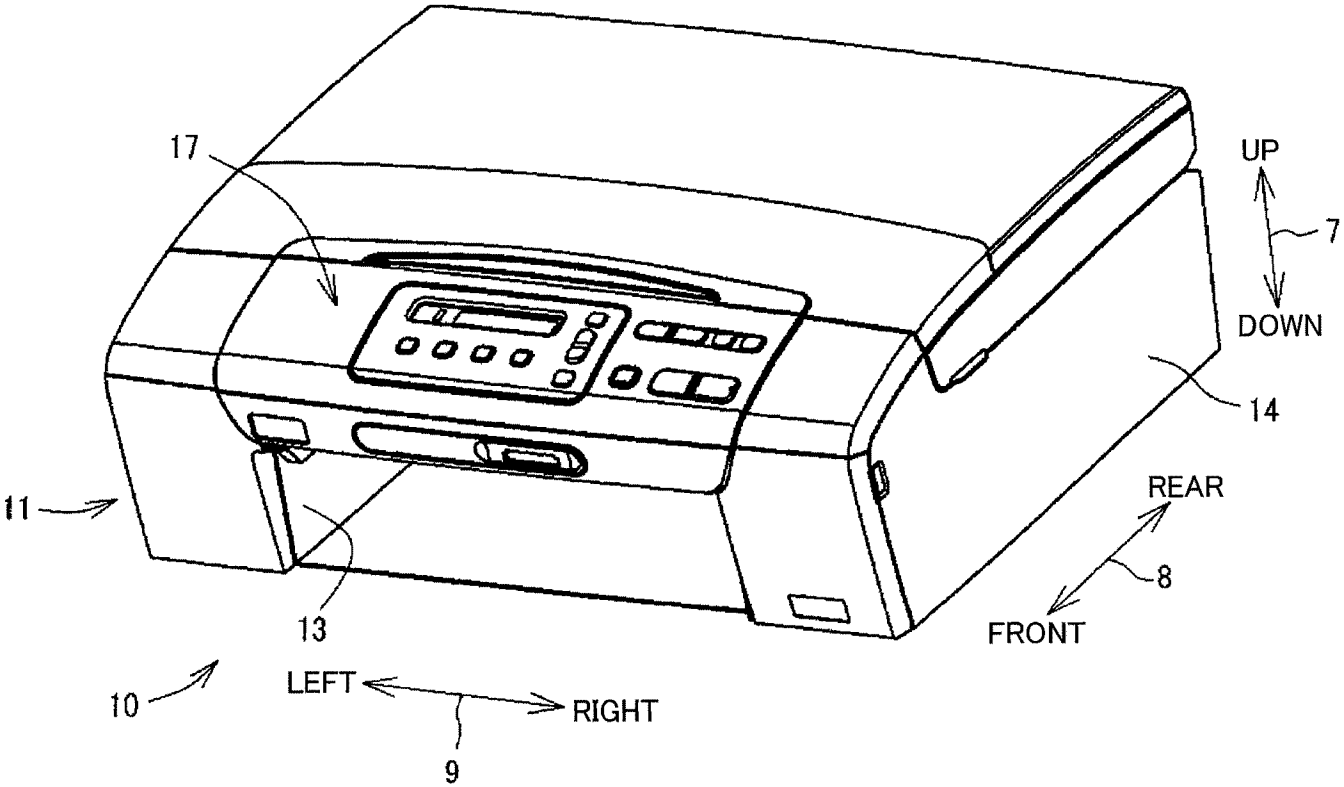
FIG. 1 is a perspective view illustrating a multifunction peripheral according to an embodiment of the present disclosure.

A multifunction peripheral 10 (hereinafter, simply referred to as "MFP 10") as an example of an image recording apparatus according to an embodiment of the present disclosure will be described with reference to FIGS. 1 to 16. In the following description, an up-down direction 7 is defined assuming that the MFP 10 is disposed in an orientation in which it is intended to be used (a state illustrated in FIG. 1). A front-rear direction 8 is defined assuming that the side of the MFP 10 at which an opening 13 is formed is a near side (a front side) of the MFP 10. A left-right direction 9 is defined assuming that the MFP 10 is viewed from the front side thereof. Further, forward rotation implies clockwise rotation, and reverse rotation implies counter-clockwise direction in the drawings.

<MFP 10>

As illustrated in FIG. 1, the MFP 10 has a thin rectangular parallelepiped shape. The MFP 10 includes a printing portion 11, in which an inkjet image-recording system is employed to record images. The printing portion 11 is positioned at a lower portion of the MFP 10. The MFP 10 provides various functions such as facsimile function and printing function. Specifically, the MFP 10 has, as the printing function, double-sided image recording function to record an image on each surface of a recording sheet such as a sheet of paper. The recording sheet is an example of a recording medium.

The printing portion 11 includes a casing 14 whose front side is formed with the opening 13. A sheet supply tray 20 and a discharge tray 21 (see FIG. 2) are configured to be inserted into and removed from the casing 14 through the opening 13 in the front-rear direction 8. Recording sheets of various sizes can be placed on the sheet supply tray 20 and the discharge tray 21. The sheet supply tray 20 is an example of an accommodation portion.

<Operation Receiving Part 17>

As illustrated in FIG. 1, an operation receiving portion 17 is provided at an upper-front portion of the MFP 10. The operation receiving portion 17 includes various buttons and the like and is configured to receive user's operation. A user can operate the operation receiving portion 17 to input, into the MFP 10, information necessary for printing. The MFP 10 is configured to perform an image recording based on the information inputted by the user. Incidentally, the MFP 10 may be configured to perform an image recording based on information inputted from an external device connected to the MFP 10 through a communication line (either wired or wireless).

<Sheet-Feeding Portion 15>

Figure 2:
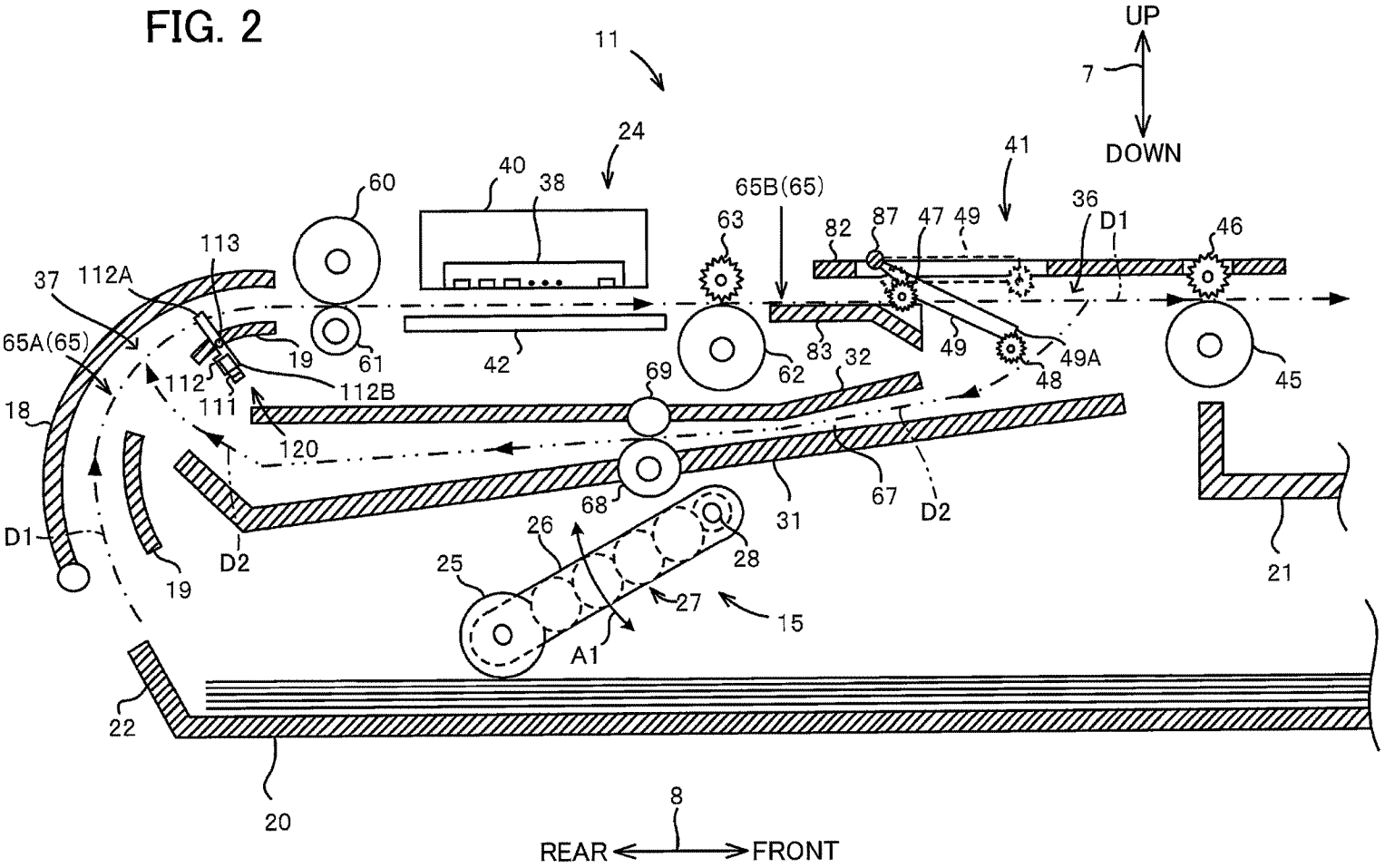
FIG. 2 is a schematic vertical cross-sectional view illustrating an internal structure of a printing portion of the multifunction peripheral according to the embodiment of the present disclosure.

As illustrated in FIG. 2, a sheet-feeding portion 15 is provided above the sheet supply tray 20 and below a recording portion 24. The sheet-feeding portion 15 includes a sheet-feeding roller 25, a sheet-feeding arm 26 and a drive transmission portion 27. The sheet-feeding roller 25 is rotatably supported at a distal end portion of the sheet-feeding arm 26. The sheet-feeding arm 26 is configured to pivotally move in a direction indicated by an arrow A1 about a shaft 28 provided at a base end portion of the sheet-feeding arm 26. With this configuration, the sheet-feeding roller 25 can come into contact with recording sheets placed on the sheet supply tray 20. The sheet-feeding roller 25 is an example of a supply roller.

The drive transmission portion 27 is configured to transmit a driving force generated by forward rotation of a sheet-feeding motor 70 (see FIG. 3) to the sheet-feeding roller 25. The sheet-feeding roller 25 is configured to rotate by receiving the driving force generated by the forward rotation of the sheet-feeding motor 70. That is, when the sheet-feeding motor 70 rotates in a forward rotational direction, a driving force generated by the forward rotation of the sheet-feeding motor 70 is transmitted to the sheet-feeding roller 25, so that the sheet-feeding roller 25 rotates. On the other hand, when the sheet-feeding motor 70 rotates in a reverse rotational direction, a driving force generated by the reverse rotation of the sheet-feeding motor 70 is not transmitted to the sheet-feeding roller 25 and therefore the sheet-feeding roller 25 does not rotate. In a state where the sheet-feeding roller 25 is in contact with an uppermost recording sheet of the stack of the recording sheets placed on the sheet supply tray 20, the sheet-feeding roller 25 feeds the uppermost recording sheet toward a curved passage 65A (described later). Note that the sheet-feeding motor 70 applies a driving force to not only the sheet-feeding roller 25 but also a double-sided conveying roller 68 described later. The sheet-feeding motor 70 is an example of a roller driver, and also is an example of a third motor.

<First Conveying Passage 65>

As illustrated in FIG. 2, a first conveying passage 65 is formed inside the printing portion 11. Specifically, within the printing portion 11, the first conveying passage 65 is formed from a distal end (i.e., a rear end) of the sheet supply tray 20 to the discharge tray 21 through the recording portion 24. The first conveying passage 65 is partitioned into the curved passage 65A and a linear passage 65B. In other words, the first conveying passage 65 includes the curved passage 65A and the linear passage 65B. The curved passage 65A is formed from the distal end of the sheet supply tray 20 to a conveying roller 60. The linear passage 65B is formed from the conveying roller 60 to the discharge tray 21. The conveying roller 60 is an example of a first conveying roller.

The curved passage 65A has a curved shape and extends from the vicinity of an upper end of an inclined portion 22 formed at the sheet supply tray 20 to the recording portion 24. The curved passage 65A is formed in a substantially arc shape whose center is positioned at an interior side of the printing portion 11. The recording sheet fed from the sheet supply tray 20 by the sheet-feeding roller 25 is curved and guided along the curved passage 65A in a first conveying direction D1 (an arrow direction indicated by a dashed-dotted line in FIG. 2) to a sheet nipping position between the conveying roller 60 and a pinch roller 61. The curved passage 65A is formed by an outer guide member 18 and an inner guide member 19 which face each other with a predetermined interval therebetween. Hereinafter, the sheet nipping position between the conveying roller 60 and the pinch roller 61 is referred to as "first nipping position."

The linear passage 65B has a linear shape and extends from the first nipping position to the discharge tray 21. The recording sheet is guided along the linear passage 65B in the first conveying direction D1. At a portion at which the recording portion 24 is provided, a part of the linear passage 65B is formed by a platen 42 which can support the recording sheet. At a portion at which the recording portion 24 is not provided, the linear passage 65B is formed by an upper guide member 82 and a lower guide member 83 which face each other with a predetermined interval therebetween.

Further, the linear passage 65B is connected to a second conveying passage 67 (described later) at a branching portion 36. The branching portion 36 is positioned downstream in the first conveying direction D1 relative to both the recording portion 24 and a discharge roller 62 (described later). During double-sided image recording, after the recording sheet is conveyed along the linear passage 65B and the upstream end in the first conveying direction D1 of the recording sheet reaches the branching portion 36, the recording sheet is conveyed, in a switch-back manner, toward the second conveying passage 67 in a direction opposite to the first conveying direction D1 by a reversing roller 45. The discharge roller 62 is an example of the first conveying roller.

<Recording Portion 24>

As illustrated in FIG. 2, the recording portion 24 is provided at the linear passage 65B of the first conveying passage 65 and is positioned downstream of the conveying roller 60 in the first conveying direction D1. The recording portion 24 includes a carriage 40 and a recording head 38 mounted thereon. The carriage 40 is reciprocatingly movable along an image recording surface of the recording sheet supported on the platen 42 in the left-right direction 9 (i.e., a direction perpendicular to the first conveying direction D1).

For example, the carriage 40 is supported by two guide rails (not illustrated), which are provided inside the printing portion 11 so as to extend in the left-right direction 9. The two guide rails are spaced away from each other with a predetermined interval therebetween in the front-rear direction 8. The carriage 40 spans across the two guide rails so as to be reciprocatingly slidable on the two guide rails in the left-right direction 9. A known belt driving mechanism (not illustrated) is provided on an upper surface of one of the two guide rails. The belt driving mechanism includes a belt connected to the carriage 40. A driving force is transmitted from a carriage drive motor 103 (see FIG. 3) to the belt driving mechanism, thereby causing the carriage 40 to be reciprocatingly slid in the left-right direction 9. That is, the carriage drive motor 103 is configured to apply a driving force to the carriage 40.

As illustrated in FIG. 2, the recording head 38 is provided at the carriage 40 so as to face the platen 42. Each color ink of cyan (C), magenta (M), yellow (Y) and black (Bk) is supplied to the recording head 38 from a corresponding ink cartridge (not illustrated) via a corresponding ink tube (not illustrated). Nozzles (not illustrated) are formed on a nozzle surface defined at a lower surface of the recording head 38. The nozzles are provided for each color ink of C, M, Y and Bk. The nozzles eject minute ink droplets of colors of C, M, Y and Bk.

Upon conveyance of a recording sheet onto the platen 42, the carriage 40 starts to reciprocatingly move in the left-right direction 9. Thus, the recording head 38 is scanned in the left-right direction 9 with respect to the recording sheet that is being conveyed on the platen 42 provided below the recording portion 24. Further, the recording head 38 ejects ink droplets through the nozzles toward the recording sheet. As a result, an image is recorded on a top surface (i.e., image recording surface) of the recording sheet.

<Conveying Roller 60>

As illustrated in FIG. 2, the conveying roller 60 and the pinch roller 61 are provided at the first conveying passage. The conveying roller 60 and the pinch roller 61 are positioned between the recording portion 24, and the outer guide member 18 and the inner guide member 19. The pinch roller 61 is positioned below the conveying roller 60 and is placed in pressure contact with a roller surface of the conveying roller 60 by an elastic member (not illustrated) such as a spring. The recording sheet that has been fed to the curved passage 65A by the sheet-feeding roller 25 is nipped by the conveying roller 60 and the pinch roller 61, and is conveyed along the linear passage 65B in the first conveying direction D1 by the conveying roller 60 and the pinch roller 61. In this way, the recording sheet is conveyed onto the platen 42.

<Discharge Roller 62>

The discharge roller 62 and a spur 63 are provided at the linear passage 65B of the first conveying passage 65. The discharge roller 62 and the spur 63 are positioned between the recording portion 24, and the upper guide member 82 and the lower guide member 83. The spur 63 is positioned above the discharge roller 62, and is placed in pressure contact with a roller surface of the discharge roller 62 by an elastic member (not illustrated) such as a spring. The recording sheet on which an image has been recorded by the recording portion 24 is nipped and conveyed in the first conveying direction D1 by the discharge roller 62 and the spur 63.

A driving force of forward rotation of a first conveying motor 71 (see FIG. 3) and a driving force of reverse rotation of the first conveying motor 71 are transmitted to both the conveying roller 60 and the discharge roller 62 via a first transmission portion 300 (described later), thereby causing the conveying roller 60 and the discharge roller 62 to rotate. That is, the first conveying motor 71 applies the driving force to both the conveying roller 60 and the discharge roller 62. Specifically, when the first conveying motor 71 rotates in a forward rotational direction, the conveying roller 60 rotates in a reverse rotational direction, and the discharge roller 62 rotates in a forward rotational direction. On the other hand, when the first conveying motor 71 rotates in a reverse rotational direction, the conveying roller 60 rotates in a forward rotational direction, and the discharge roller 62 rotates in a reverse rotational direction. Thus, the driving force generated by the forward rotation of the first conveying motor 71 is transmitted to both the conveying roller 60 and the discharge roller 62, thereby causing the conveying roller 60 and the discharge roller 62 to convey the recording sheet in the first conveying direction D1.

<Reversing Roller 45>

As illustrated in FIG. 2, the reversing roller 45 and a spur 46 are provided at the linear passage 65B of the first conveying passage 65. The reversing roller 45 and the spur 46 are positioned downstream in the first conveying direction D1 relative to the discharge roller 62. The spur 46 is positioned above the reversing roller 45, and is placed in pressure contact with a roller surface of the reversing roller 45 by an elastic member (not illustrated) such as a spring. The reversing roller 45 is an example of a second conveying roller.

The rotation driving force of the first conveying motor 71 and a rotation driving force of a second conveying motor 72 are selectively transmitted to the reversing roller 45 by the first transmission portion 300 and a second transmission portion 400 (described later), thereby causing the reversing roller 45 to rotate in a forward rotational direction or a reverse rotational direction. In a state where the rotation driving force of the first conveying motor 71 can be transmitted to the reversing roller 45, the reversing roller 45 rotates in the forward rotational direction when the first conveying motor 71 rotates in the forward rotational direction, whereas the reversing roller 45 rotates in the reverse rotational direction when the first conveying motor 71 rotates in the reverse rotational direction. On the other hand, in a state where the rotation driving force of the second conveying motor 72 can be transmitted to the reversing roller 45, only the rotation driving force generated by the forward rotation of the second conveying motor is transmitted to the reversing roller 45, thereby causing the reversing roller 45 to rotate in the reverse rotational direction. The first conveying motor 71 is an example of a first motor. The second conveying motor 72 is an example of a second motor.

The reversing roller 45 rotates in the forward rotational direction to thereby convey the recording sheet in the first conveying direction D1. Thus, the recording sheet is nipped by the reversing roller 45 and the spur 46 and is conveyed in the first conveying direction D1, so that the image recording by the recording portion 24 or discharge of the recording sheet to the discharge tray 21 is performed. Further, in a case where the double-sided recording is performed, when the upstream end in the first conveying direction D1 of the recording sheet has been conveyed to the branching portion 36, the rotation direction of the reversing roller 45 is switched from the forward rotation to the reverse rotation. Consequently, the recording sheet is conveyed in a direction opposite to the first conveying direction D1 by the reverse rotation of the reversing roller 45, and is guided toward the second conveying passage 67 by a path-switching portion 41 (described later).

<Path-Switching Portion 41>

As illustrated in FIG. 2, the path-switching portion 41 is provided at the linear passage 65B of the first conveying passage 65. The path-switching portion 41 is positioned downstream of the discharge roller 62 and upstream of the reversing roller 45 in the first conveying direction D1. The path-switching portion 41 includes auxiliary rollers 47 and 48, a flap 49, and a shaft 87.

The shaft 87 of the path-switching portion 41 is provided at a frame (not illustrated) of the printing portion 11. The flap 49 extends substantially downstream in the first conveying direction D1 from the shaft 87, and is pivotally movably supported by the shaft 87. The auxiliary rollers 47 and 48 are rotatably supported by the flap 49. Roller surfaces of the auxiliary rollers 47 and 48 are formed in spur shapes similar to the spurs 63 and 46.

The flap 49 is configured to change its posture. The flap 49 is pivotally movable between a discharging posture (a posture indicated by a broken line in FIG. 2) and a reversing posture (a posture indicated by a solid line in FIG. 2). At the discharging posture, the flap 49 is positioned above the lower guide member 83. At the reversing posture, an extended end 49A of the flap 49 is positioned below the branching portion 36. Normally, the flap 49 is rendered in the reversing postures by its own weight. On the other hand, the extended end 49A of the flap 49 is lifted by the recording sheet that is being conveyed along the linear passage 65B in the first conveying direction D1, so that the flap 49 is pivotally moved to be changed in its posture to the discharging posture. When a rear end of the recording sheet has been moved past the auxiliary roller 47, the flap 49 is pivotally moved and changed in its posture from the discharging posture to the reversing posture. When the reversing roller 45 continues rotating in the forward rotational direction in this state, the recording sheet is discharged to the discharge tray 21. On the other hand, when the rotation direction of the reversing roller 45 is switched from the forward rotation to the reverse rotation, the recording sheet is guided by the flap 49 taking the reversing posture, and is conveyed toward the second conveying passage 67. The flap 49 may be configured to be pivotally moved by a motor and the like.

<Second Conveying Passage 67>

As illustrated in FIG. 2, the second conveying passage 67 is branched from the linear passage 65B of the first conveying passage 65 at the branching portion 36 and joins (or is merged with) the curved passage 65A of the first conveying passage 65 at a joining portion 37 that is positioned upstream of the recording portion 24 in the first conveying direction D1. The second conveying passage 67 extends from the branching portion 36 to the joining portion 37 while passing through a portion below the recording portion 24 and above the sheet-feeding portion 15. The recording sheet is guided along the second conveying passage 67 in a second conveying direction D2. Note that the second conveying direction D2 is a direction from the branching portion 36 toward the joining portion 37 and is indicated by an arrowed dashed-two dotted chain in FIG. 2. A part of the upper portion of the second conveying passage 67 is formed by a second guide member 32. Further, a part of the lower portion of the second conveying passage 67 is formed by a first guide member 31. In the present embodiment, a length in the second conveying direction D2 of the second conveying passage 67 is configured to be longer than a length in the second conveying direction D2 of a recording sheet of a maximum size among sizes which can be printed (or subjected to the image recording) by the MFP 10. In other words, the second conveying passage 67 is longer than a length along the second conveying passage 67 of a recording sheet of a maximum size among sizes which can be printed by the MFP 10. The maximum size denotes, for example, a recording sheet of a maximum size which can be supported by (or placed on) the sheet supply tray 20.

<Double-Sided Conveying Roller 68>

As illustrated in FIG. 2, the double-sided conveying roller 68 and a follower roller 69 are provided at the second conveying passage 67. The double-sided conveying roller 68 is positioned below the follower roller 69 so as to face the same. The double-sided conveying roller 68 is configured to rotate in a reverse rotational direction by receiving the rotation driving force of the reverse rotation of the sheet-feeding motor 70 (see FIG. 3) transmitted therefrom through a power transmission portion (not illustrated). That is, when the sheet-feeding motor 70 rotates in the forward rotational direction, the rotation driving force generated by the forward rotation of the sheet-feeding motor 70 is not transmitted to the double-sided conveying roller 68 and thus the double-sided conveying roller 68 does not rotate. On the other hand, when the sheet-feeding motor 70 rotates in the reverse rotational direction, the rotation driving force generated by the reverse rotation of the sheet-feeding motor 70 is transmitted to the double-sided conveying roller 68, thereby causing the double-sided conveying roller 68 to rotate in the reverse rotational direction. Thus, upon conveyance of the recording sheet to the second conveying passage 67 by the reversing roller 45, the recording sheet is nipped between the double-sided conveying roller 68 and the follower roller 69 and is conveyed along the second conveying passage 67 in the second conveying direction D2 by the double-sided conveying roller 68 and the follower roller 69. When the recording sheet has conveyed to the curved passage 65A via the joining portion 37 by the double-sided conveying roller 68 and the follower roller 69, the front and back sides of the recording sheet is reversed. The double-sided conveying roller 68 is an example of a third conveying roller.

<Sheet-Detection Sensor 120>

As illustrated in FIG. 2, the printing portion 11 further includes a sheet-detection sensor 120. The sheet-detection sensor 120 is provided at a predetermined position along the curved passage 65A. The sheet-detection sensor 120 is configured to detect whether the recording sheet is at the predetermined position, and output a signal (detection signal) indicative of a result of the detection. For example, the sheet-detection sensor 120 may output a high-level signal while a portion of recording sheet is passing through the sheet-detection sensor 120, and may output a low-level signal while no recording sheet is passing through the sheet-detection sensor 120. The sheet-detection sensor 120 is an example of a detecting portion.

The sheet-detection sensor 120 includes a pivot member 112, and an optical sensor 111 such as a photo-interrupter. The pivot member 112 includes detection parts 112A and 112B. Specifically, the detection part 112A is provided on one end of the pivot member 112, while the detection part 112B is provided on another end of the pivot member 112. The pivot member 112 is pivotally movable about a shaft 113. The shaft 113 is assembled to the inner guide member 19.

The optical sensor 111 includes a light-emitting element (e.g., light-emitting diode) configured to emit light, and a light-receiving element (e.g., phototransistor) configured to receive the light emitted by the light-emitting element.

While the recording sheet is conveyed along the first conveying passage 65, a leading end of the recording sheet (i.e., a downstream end in the first conveying direction D1) abuts on the detection part 112A of the pivot member 112 and pushes the detection part 112A. As the detection part 112A is pushed by the recording sheet that is being conveyed, the detection part 112B of the pivot member 112 is displaced from an optical path between the light-emitting element and the light-receiving element, thereby allowing the light emitted from the light-emitting element to reach the light-receiving element along the optical path. At this time, the light-receiving element therefore outputs a high-level signal.

When a trailing end of the recording sheet (an upstream end in the first conveying direction D1) moves past the detection part 112A of the pivot member 112 as the recording sheet is being conveyed along the first conveying passage 65, the pivot member 112 returns to a state illustrated in FIG. 2. The detection part 112B of the pivot member 112 thus enters into the optical path between the light-emitting element and the light-receiving element to block the light traveling along the optical path. At this time, the light-receiving element outputs a low-level signal. The optical sensor 111 is configured to output, as the detection signal, an electrical analog signal corresponding to an intensity of the light received by the light-receiving element. A controller 130 (see FIG. 3), which is configured to control overall operations of the MFP 10, is configured to detect whether the recording sheet is at the predetermined position on the basis of differences in the electric signal outputted from the optical sensor 111.

<First Rotary Encoder 73, Second Rotary Encoder 75, and Third Rotary Encoder 76>

Figure 3:
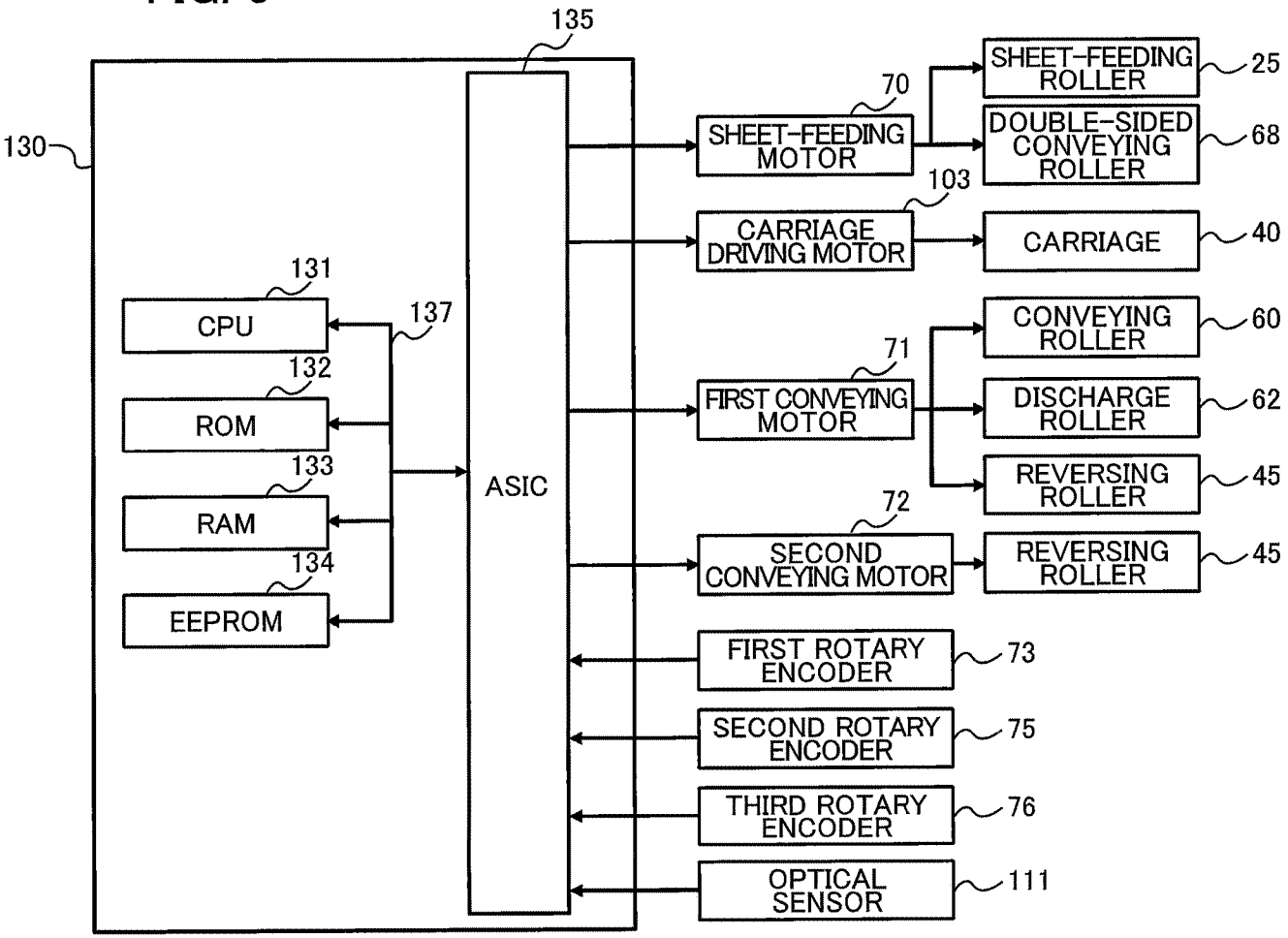
FIG. 3 is a block diagram illustrating a structure of a controller of the multifunction peripheral according to the embodiment of the present disclosure.

As illustrated in FIG. 3, the MFP 10 includes a first rotary encoder 73, a second rotary encoder 75, and a third rotary encoder 76. The first rotary encoder 73 is coupled to a rotation shaft (not illustrated) of the first conveying motor 71, the second rotary encoder 75 is coupled to a rotation shaft of the second conveying motor 72, and the third rotary encoder 76 is coupled to a rotation shaft of the sheet-feeding motor 70.

The first rotary encoder 73 includes a well-known encoder disk (not illustrated), and a well-known optical sensor (not illustrated). The encoder disk is rotatable together with the rotation shaft of the first conveying motor 71. The encoder disk is formed with a plurality of transmissive portions configured to transmit light and a plurality of non-transmissive portions configured not to transmit light. The transmissive portions and the nontransmissive portions are arranged alternately at an equal pitch in a circumferential direction of a circle concentric to a rotation center axis of the encoder disk. The optical sensor is provided to face a portion of the encoder disk which portion is formed with the pattern configured of the transmissive portions and the nontransmissive portions. The optical sensor is configured to generate pulse signals based on the pattern formed in the encoder disk while the encoder disk rotates together with the rotation shaft of the first conveying motor 71. The generated pulse signals are configured to be outputted to the controller 130 from the optical sensor. Note that since each of the second rotary encoder 75 and the third rotary encoder 76 has a configuration the same as that of the first rotary encoder 73, detailed descriptions to the second rotary encoder 75 and the third rotary encoder 76 will be omitted. Each of the first rotary encoder 73, the second rotary encoder 75, and the third rotary encoder 76 is an example of the detecting portion.

<Controller 130>

The controller 130 is configured to control the overall operations of the MFP 10. As illustrated in FIG. 3, the controller 130 is configured as a microcomputer that includes a CPU 131, a ROM 132, a RAM 133, an EEPROM 134, and an ASIC 135. These elements are connected by an internal bus.

The ROM 132 stores programs in accordance with which CPU 131 can control various operations. The RAM 133 serves as a storage area for temporarily storing data and signals that is necessary for execution of the programs by the CPU 131, or as a work area for data processing. The EEPROM 134 stores settings and flags that should be stored even after the MFP 10 is shut off.

The ASIC 135 is connected to the sheet-feeding motor 70, the carriage drive motor 103, the first conveying motor 71, and the second conveying motor 72. When a drive signal for driving each motor is inputted to a corresponding drive circuit from the CPU 131, a driving current based on the drive signal is configured to be outputted to the corresponding motor from the drive circuit, thereby causing each of these motors 70, 103, 71 and 72 to rotate in the forward direction or the reverse direction at a predetermined rotation speed. In other words, the controller 130 is configured to control rotations (driving) of each of the sheet-feeding motor 70, the carriage drive motor 103, the first conveying motor 71, and the second conveying motor 72.

The pulse signals outputted from the optical sensors of the first rotary encoder 73, the second rotary encoder 75, and the third rotary encoder 76 are configured to be inputted to the ASIC 135. The controller 130 is configured to calculate the rotation amount for each of the first conveying motor 71, the second conveying motor 72, and the sheet-feeding motor 70 by counting the number of edges of the pulse signals inputted from the optical sensors. In other words, the controller 130 can perform rotation control for each of the motors 71, 72, and 70. For example, the controller 130 determines, for each of the motors 71, 72, and 70, whether the number of the counted edges of the pulse signals reaches a number (i.e., a target number) that indicates a prescribed target rotation amount: when the number of the counted edges for the first conveying motor 71 reaches the target number therefor, the controller 130 stops driving the first conveying motor 71; when the number of the counted edges for the second conveying motor 72 reaches the target number therefor, the controller 130 stops driving the second conveying motor 72; and when the number of the counted edges for the sheet-feeding motor 70 reaches the target number therefor, the controller 130 stops driving the sheet-feeding motor 70. Further, the controller 130 calculates conveyance amount of the recording sheet on the basis of the calculated rotation amounts of the motors 71, 72, and 70. Then, the controller 130 determines, on the basis of the calculated conveyance amount, where the recording sheet is located. Thus, by controlling the rotation of each of the first conveying motor 71, the second conveying motor 72, and the sheet-feeding motor 70, the controller 130 controls rotations of the rollers rotated by the motors 71, 72, and 70 to thereby control conveyance of the recording sheet.

The ASIC 135 is also connected to the optical sensor 111 of the sheet-detection sensor 120. Electric signals outputted from the optical sensor 111 are configured to be inputted to the controller 130. The controller 130 determines whether an electrical level (i.e., a voltage value or a current value) of the inputted electric signal is equal to or greater than a predetermined value. When the electrical level of the inputted electric signal is equal to or greater than the predetermined value, the controller 130 determines that the inputted electric signal is a high-level signal. On the other hand, when the electrical level is lower than the predetermined value, the controller 130 determines that the inputted electric signal is a low-level signal.

When the inputted electric signal is determined to be a high level signal (i.e., when the sheet-detection sensor 120 is ON), the controller 130 determines that the leading end of the recording sheet has moved past the pivot member 112 but the trailing end of the recording sheet has not yet moved past the pivot member 112. On the other hand, when the inputted electric signal is determined to be a low level signal (i.e., the sheet-detection sensor 120 is OFF), the controller 130 determines that the leading end of the recording sheet has not reached the pivot member 112 or that the trailing end of the recording sheet has already moved past the pivot member 112.

<Power Transmission Mechanism 200>

Figure 4:
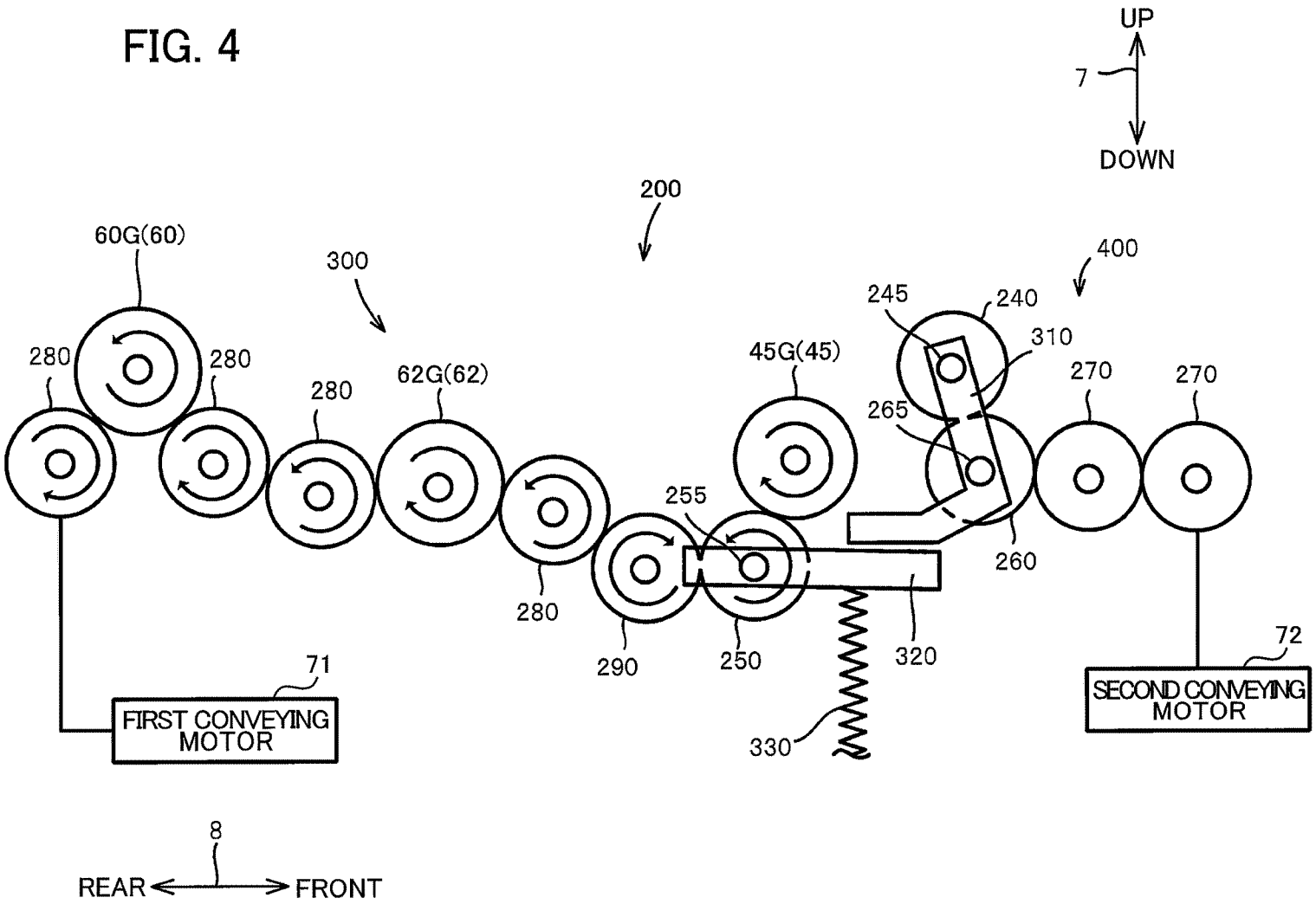
FIG. 4 is a schematic view illustrating structures of a first transmission portion and a second transmission portion of the multifunction peripheral according to the embodiment of the present disclosure.

As illustrated in FIG. 4, the MFP 10 further includes a power transmission mechanism 200. The power transmission mechanism 200 is configured to be switched between a first transmission state and a second transmission state.

In the first transmission state, the power transmission mechanism 200 can transmit the rotation driving force of the first conveying motor 71 to the conveying roller 60, the discharge roller 62, and the reversing roller 45. In the second transmission state, the power transmission mechanism 200 can transmit the rotation driving force of the first conveying motor 71 to the conveying roller 60 and the discharge roller 62, and transmit the driving force of the second conveying motor 72 to the reversing roller 45. Further, in the second transmission state, the power transmission mechanism 200 does not transmit the driving force of the first conveying motor 71 to the reversing roller 45. The power transmission mechanism 200 includes the first transmission portion 300, the second transmission portion 400, and gears 60G, 62G, and 45G. The first transmission state is an example of a first state. The second transmission state is an example of a second state.

<Gears 60G, 62G, 45G>

The gears 60G, 62G, and 45G are provided at the conveying roller 60, the discharge roller 62, and the reversing roller 45, respectively. More specifically, the gears 60G is coaxially fixed to the rotation shaft of the conveying roller 60 to be rotatable integrally with the same. The gears 62G is coaxially fixed to the rotation shaft of the discharge roller 62 to be rotatable integrally with the same. The gear 45G is coaxially fixed to the rotation shaft of the reversing roller 45 to be rotatable integrally with the same.

<First Transmission Portion 300>

As illustrated in FIG. 4, the rotation driving force of the first conveying motor 71 can be transmitted to the conveying roller 60, the discharge roller 62, and the reversing roller 45 by the first transmission portion 300. The first transmission portion 300 includes a plurality of gears 280, a gear 290, a first transmission gear 250 meshingly engaged with the gear 290, a first movement member 320 coupled to a rotation shaft 255 of the first transmission gear 250, and a coil spring 330.

The plurality of gears 280 are meshingly engaged with the gear 60G and the gear 62G. The plurality of gears 280 rotate by receiving the rotation driving force transmitted from the first conveying motor 71. Thus, the rotation driving force of the first conveying motor 71 is transmitted to the conveying roller 60 and the discharge roller 62 via the gears 280. The frontmost gear 280 of the plurality of gears 280 is meshingly engaged with the gear 290. Accordingly, the gear 290 is rotatable by receiving the rotation driving force transmitted from the first conveying motor 71. The gear 290 is meshingly engaged with the first transmission gear 250. The first transmission gear 250 is meshingly engaged with the gear 45G. Thus, the rotation driving force of the first conveying motor 71 is transmitted to the reversing roller 45 via the gears 280, the gear 290, and the first transmission gear 250.

In the present embodiment, in the state illustrated in FIG. 4, when the first conveying motor 71 is rotated in the forward rotational direction, the conveying roller 60 rotate in the reverse rotational direction, and the discharge roller 62 and the reversing roller 45 rotate in the forward rotational direction. On the other hand, when the first conveying motor 71 is rotated in the reverse rotational direction, the conveying roller 60 rotates in the forward rotational direction, and the discharge roller 62 and the reversing roller 45 rotate in the reverse rotational direction. That is, when the first conveying motor 71 rotates in the forward rotational direction, the conveying roller 60, the discharge roller 62 and the reversing roller 45 rotate so as to convey the recording sheet in the first conveying direction D1. When the first conveying motor 71 rotates in the reverse rotational direction, the conveying roller 60, the discharge roller 62 and the reversing roller 45 rotate so as to convey the recording sheet in a direction opposite to the first conveying direction D1.

<First Transmission Gear 250>

As illustrated in FIG. 4, the first transmission gear 250 is coaxially fixed to the rotation shaft 255 to be rotatable integrally with the rotation shaft 255. The rotation shaft 255 is inserted in and supported by the frame (not illustrated) of the printing portion 11. More specifically, the frame of the printing portion 11 is formed with a hole, and the rotation shaft 255 is inserted in the hole of the frame and supported by the same. The hole of the frame is an elongated hole extending substantially in the up-down direction 7. As the rotation shaft 255 is movable along the elongated hole, the first transmission gear 250 is movable between a first position indicated by a broken line in FIG. 5 and a second position indicated by a solid line in FIG. 5. The first transmission gear 250 is an example of a first gear.

Figure 5:
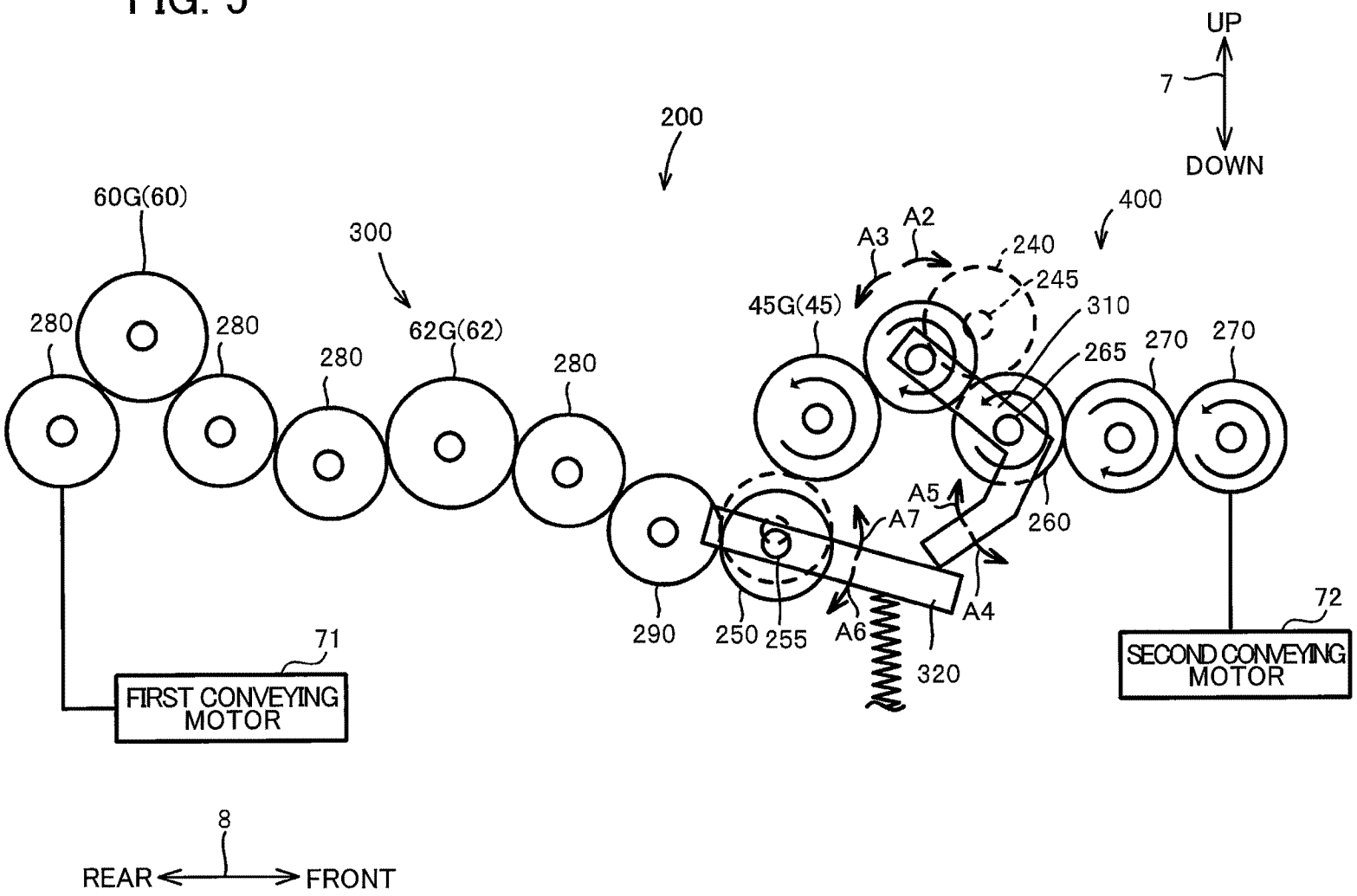
FIG. 5 is a schematic view for description of movement of a first transmission gear and a second transmission gear of the multifunction peripheral according to the embodiment of the present disclosure.

As illustrated in FIG. 5, the first transmission gear 250 at the first position is meshingly engaged with both the gear 290 and the gear 45G. The first transmission gear 250 at the second position is spaced away from the gear 45G and is meshingly engaged with only the gear 290. That is, at the first position, the first transmission gear 250 is meshingly engaged with the gear 45G and thus transmits the rotation driving force of the first conveying motor 71 to the reversing roller 45. At the second position, the first transmission gear 250 is apart from the gear 45G, and thus does not transmit the rotation driving force of the first conveying motor 71 to the reversing roller 45. The movement of the first transmission gear 250 between the first position and the second position is performed by the second transmission portion 400 (described later).

<First Movement Member 320>

As illustrated in FIG. 4, the first movement member 320 is coupled to the rotation shaft 255 of the first transmission gear 250 and thus is attached to the first transmission gear 250. The first movement member 320 is has a flat plate shape extending in the front-rear direction 8. The first movement member 320 moves integrally with the first transmission gear 250 in accompany with the movement of the first transmission gear 250 between the first position and the second position since the first movement member 320 is attached to the first transmission gear 250. The first movement member 320 is an example of an abutted portion.

The coil spring 330 is fixed to a lower surface of the first movement member 320. More specifically, the coil spring 330 has an upper end fixed to the first movement member 320, and a lower end fixed to the frame (not illustrated) of the printing portion 11. The coil spring 330 urges, with its elastic force, the first movement member 320 upward. By the urging force of the coil spring 330, the first transmission gear 250 is urged from the second position to the first position. When the first movement member 320 is pressed downward by a second movement member 310 (described later), the first movement member 320 is urged downward against the urging force of the coil spring 330, thereby causing the first movement member 320 to move from a position illustrated in FIG. 4 to a position illustrated in FIG. 5. As the first movement member 320 moves downward, the first transmission gear 250 moves from the first position to the second position. The coil spring 330 is an example of an urging member.

<Second Transmission Portion 400>

As illustrated in FIGS. 4 and 5, the rotation driving force of the second conveying motor 72 can be transmitted to the reversing roller 45 by the second transmission portion 400. The second transmission portion 400 includes a plurality of gears 270, a gear 260, a second transmission gear 240 meshingly engaged with the gear 260, and the second movement member 310.

The plurality of gears 270 are engaged with and coupled to each other, and are rotatable by receiving the rotation driving force of the second conveying motor 72 transmitted from the same. The rearmost gear 270 of the plurality of gears 270 is meshingly engaged with the gear 260. Therefore, the gear 260 is rotatable by receiving the rotation driving force of the second conveying motor 72 transmitted from the same via the plurality of gears 270. Since a rotation shaft 265 of the gear 260 is inserted in the frame (not illustrated) of the printing portion 11, a position of the gear 260 is fixed. The gear 260 is an example of a transmission gear.

<Second Transmission Gear 240>

The second transmission gear 240 is meshingly engaged with the gear 260. Thus, the rotation driving force of the second conveying motor 72 is transmitted from the same to the second transmission gear 240 via the plurality of gears 270 and the gear 260. The second transmission gear 240 is a planetary gear that is movable on an outer circumferential surface of the gear 260 while rotating on its own axis in a state of being meshingly engaged with the gear 260. That is, the second transmission gear 240 is configured to revolve around the gear 260 while rotating. The second transmission gear 240 is an example of a second gear.

When the gear 260 rotates in a forward rotational direction, the second transmission gear 240 moves in a direction indicated by an arrow A2 in FIG. 5 while rotating, i.e., the second transmission gear 240 revolves around the gear 260 in the direction of the arrow A2 while rotating. When the gear 260 rotates in a reverse rotational direction, the second transmission gear 240 moves in a direction indicated by an arrow A3 in FIG. 5, i.e., the second transmission gear 240 revolves around the gear 260 in the direction of the arrow A3 while rotating. That is, the second transmission gear 240 is configured to move (i.e., revolve around the gear 260) between a third position (indicated by a solid line in FIG. 5) and a fourth position (indicated by a broken line in FIG. 5) in accompany with the forward and reverse rotations of the gear 260.

As illustrated in FIG. 5, the second transmission gear 240 at the third position is meshingly engaged with both the gear 260 and the gear 45G. The second transmission gear 240 at the fourth position is spaced away from the gear 45G and is meshingly engaged with only the gear 260. That is, at the third position, the second transmission gear 240 is meshingly engaged with the gear 45G and thus transmits the rotation driving force of the second conveying motor 72 to the reversing roller 45. At the fourth position, the second transmission gear 240 is apart from the gear 45G, and thus does not transmit the rotation driving force of the second conveying motor 72 to the reversing roller 45.

<Second Movement Member 310>

As illustrated in FIG. 4, the second movement member 310 is coupled to both a rotation shaft 245 of the second transmission gear 240 and the rotation shaft 265 of the gear 260, whereby the second movement member 310 is attached to the second transmission gear 240 and the gear 260. The second movement member 310 has a substantially L shape. The second movement member 310 is pivotally movable about the rotation shaft 265 of the gear 260 in accompany with the movement of the second transmission gear 240 between the third position and the fourth position. The second movement member 310 is an example of an abutting portion.

As illustrated in FIG. 5, when the second transmission gear 240 moves from the fourth position to the third position, the second movement member 310 pivotally moves in a direction indicated by an arrow A4 in FIG. 5. On the other hand, when the second transmission gear 240 moves from the third position to the fourth position, the second movement member 310 pivotally moves in a direction indicated by an arrow A5. The second movement member 310 presses downward the first movement member 320 in a process of pivotally moving in the direction of the arrow A4. Thus, the second movement member 310 moves the first movement member 320 downward. When the first movement member 320 is pushed down by the second movement member 310, the first transmission gear 250 moves from the first position to the second position.

In the present embodiment, the gear 260 is configured to rotate in the forward rotational direction by transmission of the rotation driving force of the second conveying motor 72 via the gears 270 when the second conveying motor 72 rotates in the forward rotational direction. Further, the gear 260 is configured to rotate in the reverse rotational direction by transmission of the rotation driving force of the second conveying motor 72 via the gears 270 when the second conveying motor 72 rotates in the reverse rotational direction.

Hence, when the second conveying motor 72 rotates in the reverse rotational direction, i.e., when the gear 260 rotates in the reverse rotational direction, the second transmission gear 240 revolves around the gear 260 in the direction of the arrow A3 while rotating to thereby move from the fourth position to the third position. In accompany with the movement of the second transmission gear 240 from the fourth position to the third position, the second movement member 310 pivotally moves in the direction of the arrow A4. By the second movement member 310 pivotally moving in the direction of the arrow A4, the first movement member 320 is pressed to move downward, thereby causing the first transmission gear 250 to move in a direction indicated by an arrow A6 in FIG. 5. As a result, the first transmission gear 250 moves from the first position to the second position.

On the other hand, when the second conveying motor 72 rotates in the forward rotational direction, i.e., when the gear 260 rotates in the forward rotational direction, the second transmission gear 240 revolves around the gear 260 in the direction of the arrow A2 while rotating to thereby move from the third position to the fourth position. By the movement of the second transmission gear 240 from the third position to the fourth position, the second movement member 310 pivotally moves in the direction of the arrow A5 to be separated from the first movement member 320. Upon the separation of the second movement member 310, the first movement member 320 is moved upward by the urging force of the coil spring 330, thereby causing the first transmission gear 250 moves in a direction indicated by an arrow A7 in FIG. 5. As a result, the first transmission gear 250 moves from the second position to the first position.

As described above, when the second conveying motor 72 rotates in the reverse rotational direction, the second transmission gear 240 moves from the fourth position to the third position. This movement of the second transmission gear 240 causes the first transmission gear 250 to move from the first position to the second position. When the second conveying motor 72 rotates in the forward rotational direction, the second transmission gear 240 moves from the third position to the fourth position. This movement of the second transmission gear 240 causes the first transmission gear 250 to move from the second position to the first position.

As illustrated in FIG. 4, in a state where the first transmission gear 250 is positioned at the first position and the second transmission gear 240 is positioned at the fourth position, the reversing roller 45 can rotate in synchronization with the conveying roller 60 and the discharge roller 62 since the rotation driving force of the first conveying motor 71 is transmitted to the reversing roller 45. Note that the first transmission state of the power transmission mechanism 200 denotes the above state where the first transmission gear 250 is positioned at the first position and the second transmission gear 240 is positioned at the fourth position.

As illustrated in FIG. 5, in a state where the first transmission gear 250 is positioned at the second position and the second transmission gear 240 is positioned at the third position, the rotation driving force of the second conveying motor 72 is transmitted to the reversing roller 45 but the rotation driving force of the first conveying motor 71 is not transmitted to the reversing roller 45. In this state, accordingly, the reversing roller 45 can rotate independently of rotations of the conveying roller 60 and the discharge roller 62. Note that the second transmission state of the power transmission mechanism 200 denotes the above state where the first transmission gear 250 is positioned at the second position and the second transmission gear 240 is positioned at the third position.

<Continuous Double-Sided Recording Process>

A continuous double-sided recording process executed by the controller 130 will be described below. In the following description, an initial position of the first transmission gear 250 is the first position, and an initial position of the second transmission gear 240 is the fourth position. That is, an initial state of the power transmission mechanism 200 is the first transmission state. Stated differently, an initial state of the reversing roller 45 is a state where the reversing roller 45 can receive the rotation driving force of the first conveying motor 71 and thus can rotate.

Figure 17:
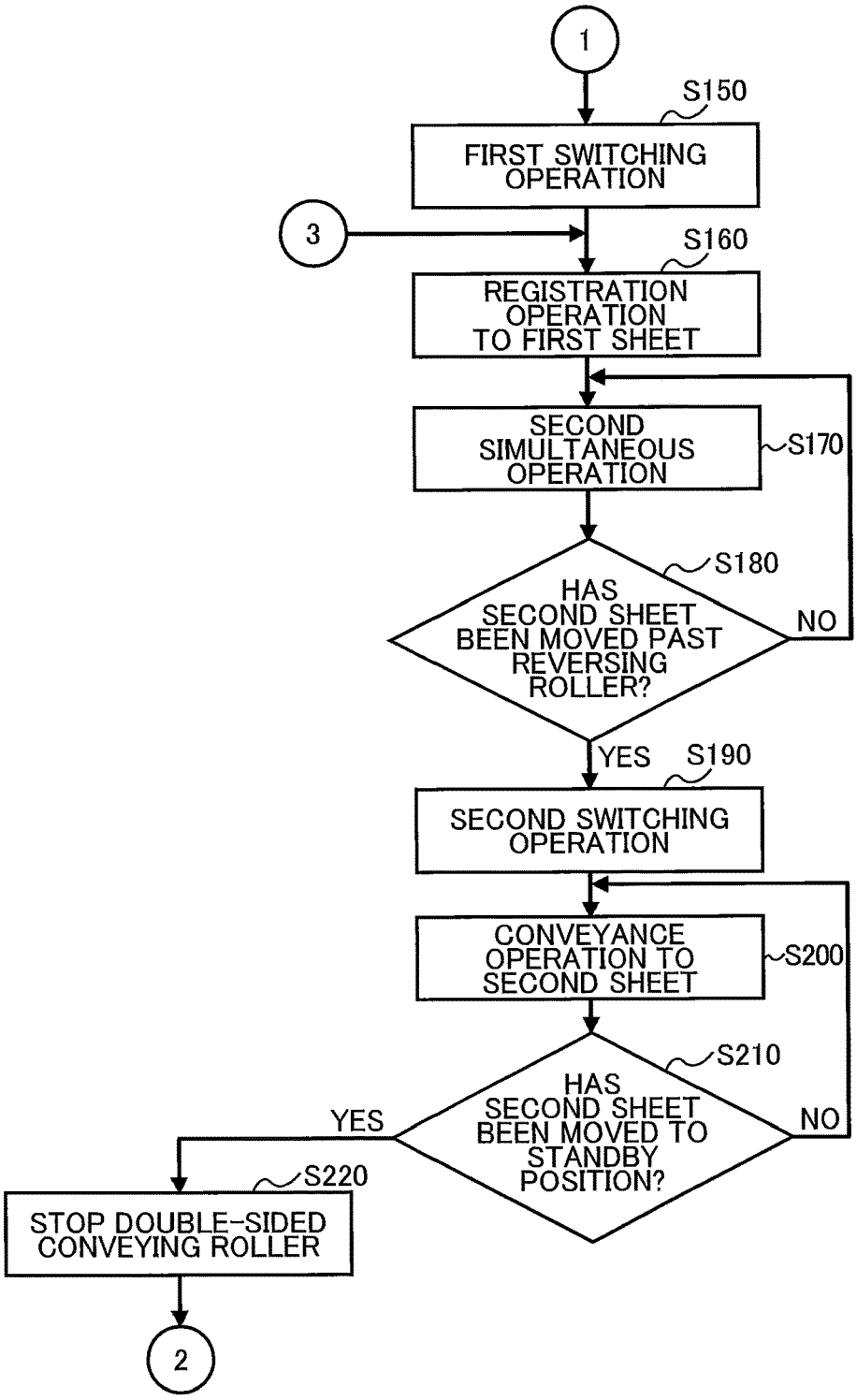
FIG. 17 is a second part of the flowchart illustrating the continuous double-sided recording process.
Figure 18:
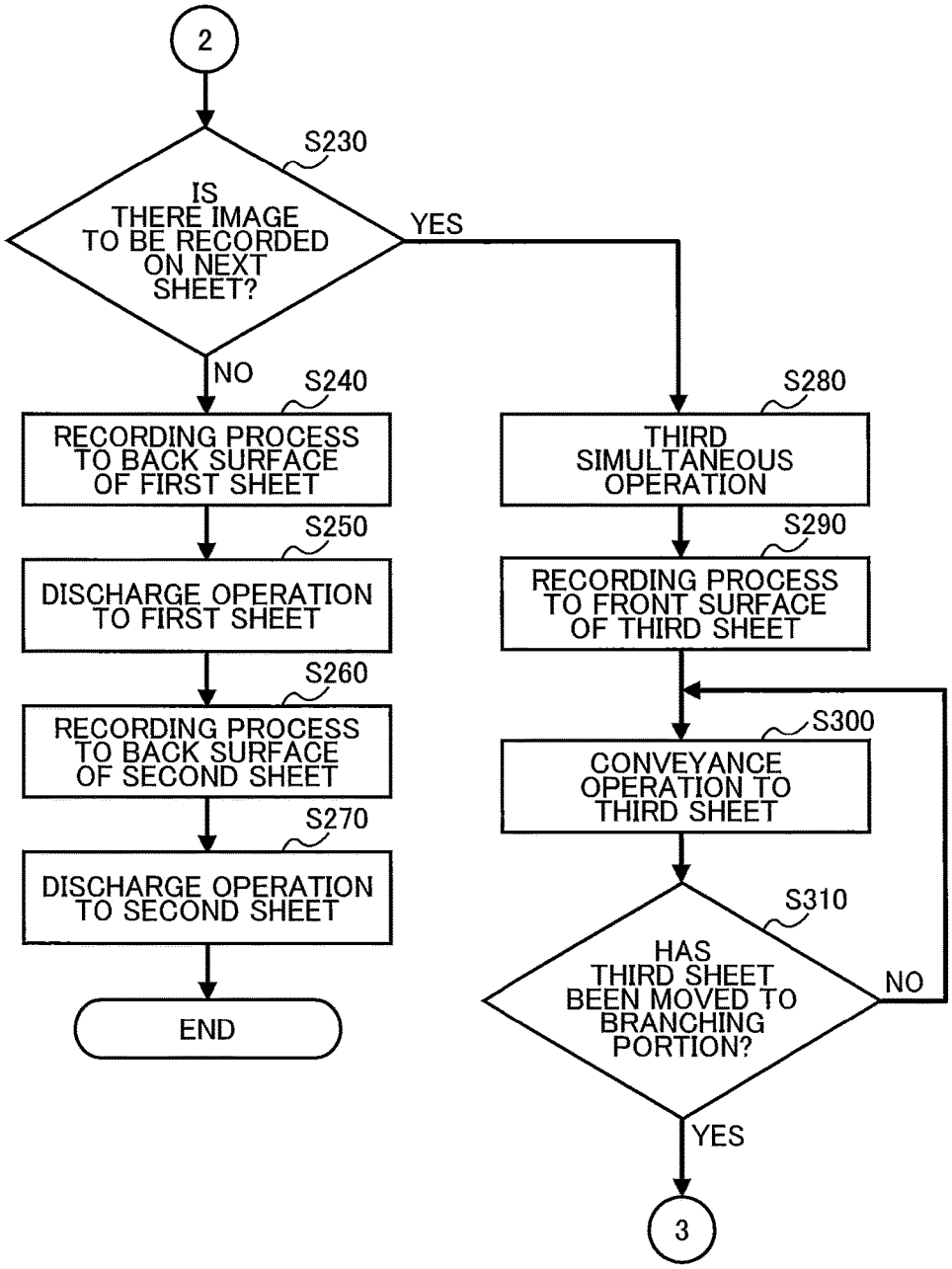
FIG. 18 is a third part of the flowchart illustrating the continuous double-sided recording process.

The controller 130 acquires an image recording instruction for the record sheet(s) through the operation receiving portion 17, a communication line, or the like. The image recording instruction includes print information which is necessary to execute image recording process. The print information includes, for example, the number of pages of images (hereinafter, referred to as "recording target images") to be recorded on the recording sheets, image data of the recording target images, a resolution of the image data, a size of recording sheet, an orientation of recording sheet, and information indicating whether to perform double-sided printing. When the controller 130 determines, by referring to the print information, that the image recording instruction to perform double-sided printing with respect to a plurality of recording sheets has been acquired, the controller 130 executes the continuous double-sided recording process illustrated in flowcharts in FIGS. 16 to 18.

Upon acquiring the image recording instruction, the controller 130 executes a sheet-feeding operation of feeding a first sheet P1 (S10). More specifically, the controller 130 rotates the sheet-feeding motor 70 in the forward rotational direction to rotate the sheet-feeding roller 25, thereby feeding (or supplying) to the curved passage 65A the first sheet P1 which is an uppermost recording sheet of the stack of recording sheets placed on the sheet supply tray 20. Subsequently, the controller 130 determines, on the basis of a signal outputted from the sheet-detection sensor 120, whether a leading end of the first sheet P1 fed by the sheet-feeding roller 25 has reached the sheet-detection sensor 120. When it is determined that the leading end of the first sheet P1 has reached the sheet-detection sensor 120, the controller 130 drives, on the basis of a signal outputted from the third rotary encoder 76, the sheet-feeding motor 70 by a predetermined rotation amount to convey the leading end of the first sheet P1 to the first nipping position between the conveying roller 60 and the pinch roller 61. When determining that the sheet-feeding motor 70 has been rotated by the predetermined amount and the leading end of the first sheet P1 has been conveyed to the first nipping position, the controller 130 stops driving the sheet-feeding motor 70 and finishes feeding the first sheet P1, i.e., finishes the sheet-feeding operation. In the present embodiment, the first sheet P1 is a sheet of paper. The first sheet P1 is an example of a first recording medium.

After then, the controller 130 executes a recording process to record an image on a front surface of the first sheet P1 (S20). More specifically, the controller 130 rotates the first conveying motor 71 in the forward rotational direction to rotate the conveying roller 60, the discharge roller 62, and the reversing roller 45, thereby conveying the first sheet P1 along the first conveying passage 65 in the first conveying direction D1. At this time, in parallel to this conveyance of the first sheet P1, the controller 130 controls the carriage drive motor 103 to drive the carriage 40, thereby performing the recording process to the front surface of the first sheet P1 using the recording portion 24. That is, the controller 130 records the image on the front surface of the first sheet P1 using the recording portion 24 while conveying the first sheet P1 along the first conveying passage 65 in the first conveying direction D1 by rotating the conveying roller 60, the discharge roller 62, and the reversing roller 45 by driving the first conveying motor 71. In this way, the image is recorded on the front surface of the first sheet P1 by the recording portion 24.

Figure 7:
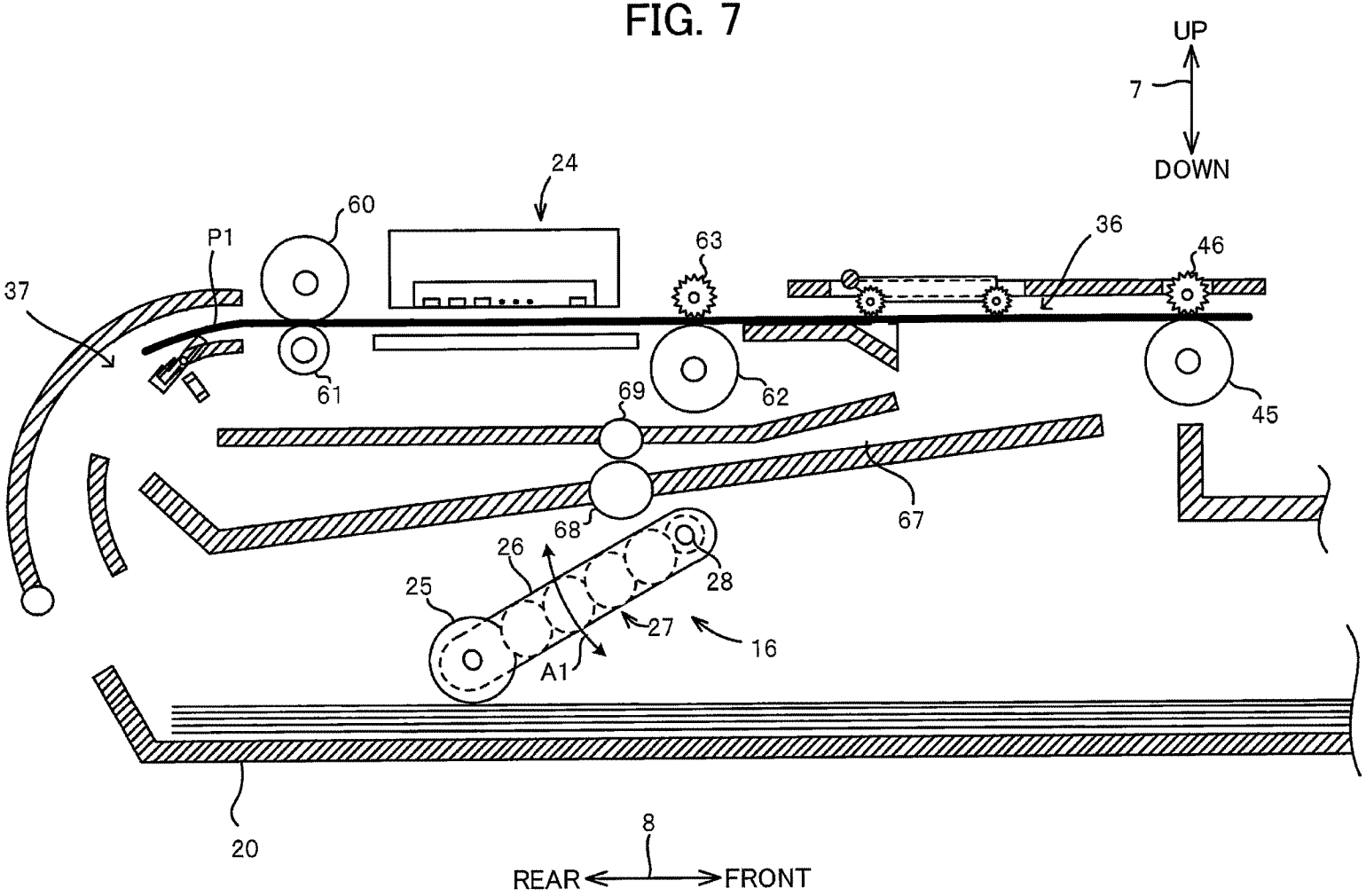
FIG. 7 is a view for description of a state of a first sheet and a second sheet in the continuous double-sided recording process.

As illustrated in FIG. 7, in S20, in a state where the first sheet P1 is nipped by the conveying roller 60, the discharge roller 62, and the reversing roller 45, the image is recorded on the front surface of the first sheet P1. That is, while the first sheet P1 is conveyed along the first conveying passage 65 in the first conveying direction D1 by the conveying roller 60, the discharge roller 62 and the reversing roller 45, the image is recorded on the front surface of the first sheet P1.

In the present embodiment, when the controller 130 executes the process in S20, the conveying roller 60, the discharge roller 62 and the reversing roller 45 are rotated by transmission of the rotation driving force of the first conveying motor 71 from the same. That is, the three rollers, namely, the conveying roller 60, the discharge roller 62 and the reversing roller 45 are rotated by the driving force of the single motor (i.e., the first conveying motor 71). Accordingly, a conveyance amount in the first conveying direction D1 of the first sheet P1 during the execution of the recording process to the first sheet P1 does not differ between the above three rollers. Consequently, the first sheet P1 can be conveyed with high conveyance accuracy, thereby suppressing disturbance of the image recorded on the first sheet P1.

Upon finishing the recording process for the front surface of the first sheet P1, the controller 130 rotates the first conveying motor 71 in the forward rotational direction to further convey the first sheet P1 along the first conveying passage 65 in the first conveying direction D1 (S30). While performing the process of S30, the controller 130 calculates the conveyance amount of the first sheet P1 on the basis of the signal outputted from the first rotary encoder 73 and determines using the calculated conveyance amount whether a trailing end (i.e., an upstream end in the first conveying direction D1) of the first sheet P1 has been moved to (or reached) the branching portion 36 by the process of S30 (S40).

When it is determined in S40 that the trailing end of the first sheet P1 has not been moved to the branching portion 36, the controller 130 returns to S30 (S40: No). That is, the controller 130 repeats the processes of S30 and S40 until the determination is made in S40 that the trailing end of the first sheet P1 has been moved to the branching portion 36. In this way, while repeating the processes of S30 and S40, the controller 130 rotates the first conveying motor 71 in the forward rotational direction to rotate the conveying roller 60, the discharge roller 62 and the reversing roller 45, thereby conveying the first sheet P1 along the first conveying passage 65 in the first conveying direction D1 until the trailing end of the first sheet P1 reaches the branching portion 36.

Figure 8:
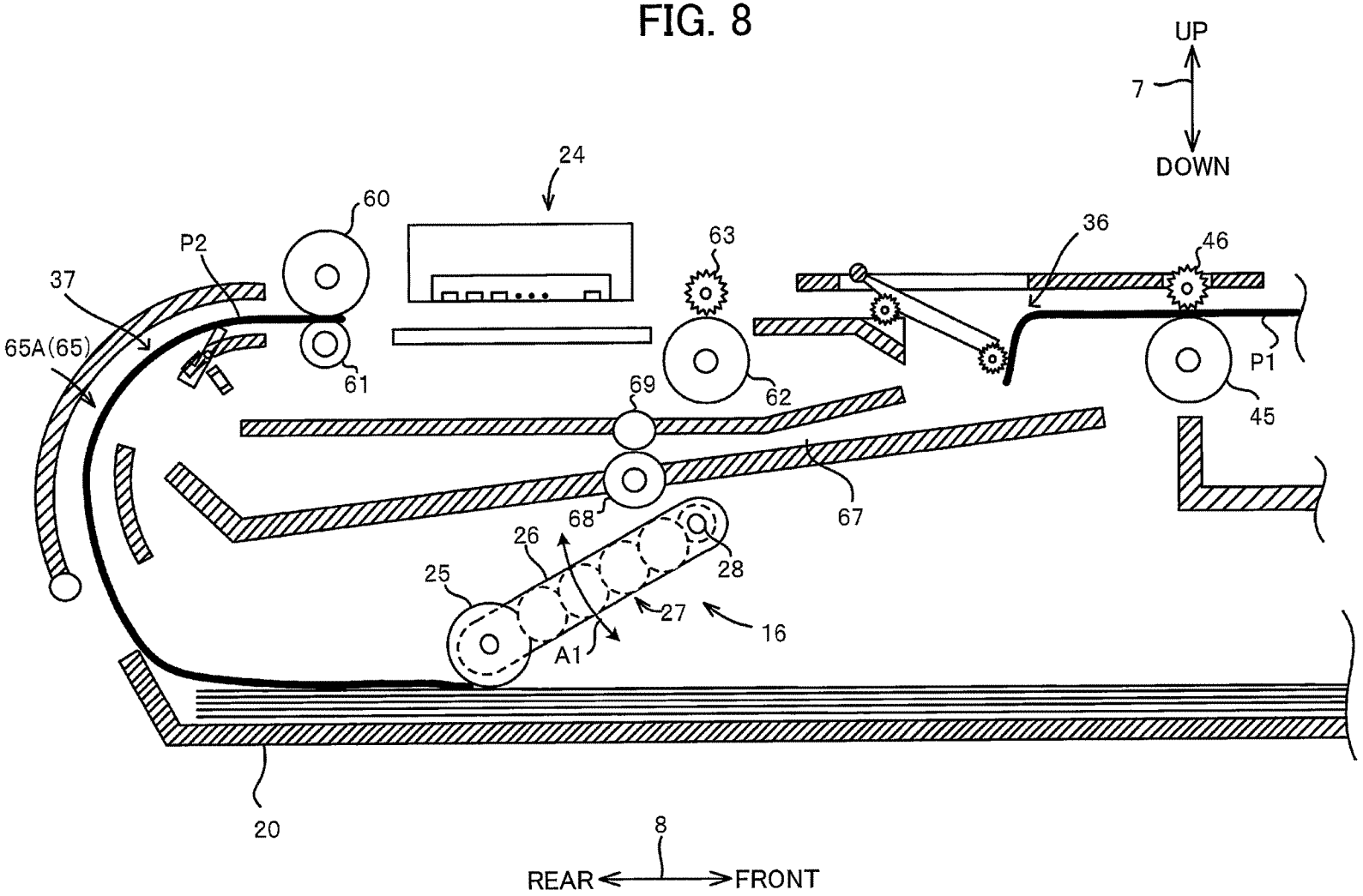
FIG. 8 is a view for description of the state of the first sheet and the second sheet in the continuous double-sided recording process.

As illustrated in FIG. 8, when it is determined in S40 that the trailing end of the first sheet P1 has been moved to the branching portion 36 (S40: Yes), the controller 130 executes a first switching operation (S50). More specifically, the controller 130 stops rotating the first conveying motor 71, and then rotates the second conveying motor 72 in the reverse rotational direction.

As described above, by rotating the second conveying motor 72 in the reverse rotational direction, the first transmission gear 250 moves from the first position to the second position, and the second transmission gear 240 moves from the fourth position to the third position. Thus, as illustrated in FIG. 5, the first transmission gear 250 is separated from the gear 45G, and the second transmission gear 240 is brought into meshing engagement with the gear 45G. That is, the controller 130 executes the first switching operation to switch the first transmission portion 300 and the second transmission portion 400 to a state where the rotation driving force of the first conveying motor 71 is not transmitted to the reversing roller 45 and the rotation driving force of the second conveying motor 72 can be transmitted to the reversing roller 45. In other words, the controller 130 performs the first switching operation to switch the power transmission mechanism 200 from the first transmission state to the second transmission state.

Further, while repeating the processes of S30 and S40, before the trailing end of the first sheet P1 is conveyed to the branching portion 36, the controller 130 rotates the sheet-feeding motor 70 in the forward rotational direction and thus rotates the sheet-feeding roller 25 to convey (or feed) a second sheet P2 subsequent to the first sheet P1 from the sheet supply tray 20 to the first nipping position (see FIG. 8). That is, within a time period from completion of the recording process in S20 until the trailing end of the first sheet P1 is moved to the branching portion 36 by the repetition of the processes of S30 and S40, the controller 130 conveys (or supply) the second sheet P2 from the sheet supply tray 20 to the conveying roller 60 by rotating the sheet-feeding roller 25. In the present embodiment, the second sheet P2 is a sheet of paper. The second sheet P2 is an example of a second recording medium.

Figure 6A:
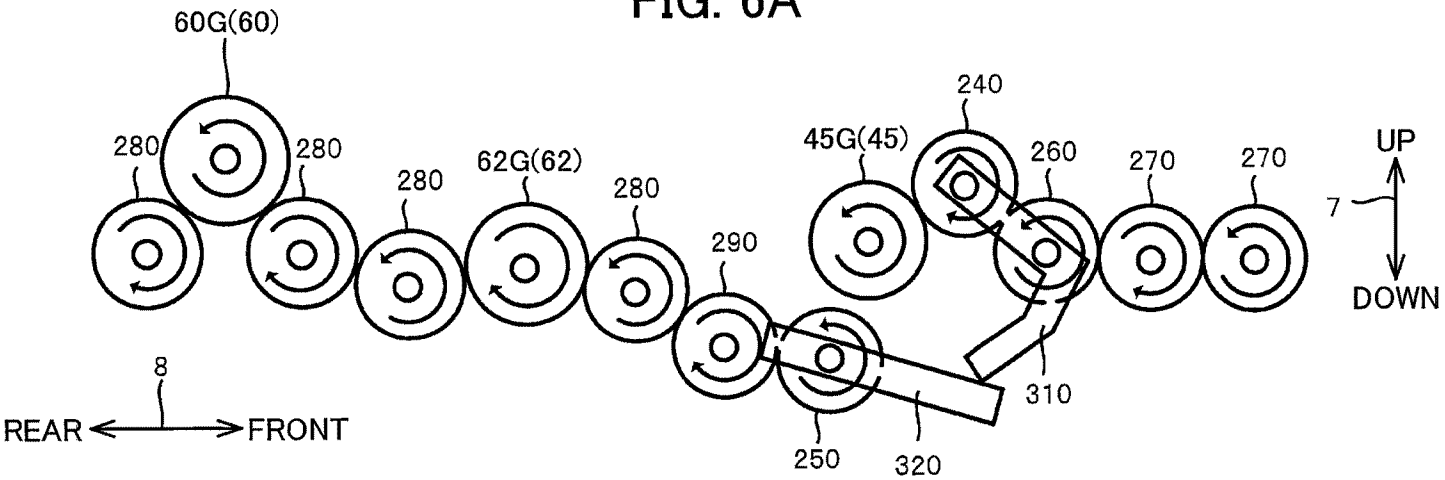
FIG. 6A is a view for description of a power transmission state of a conveyer roller, a discharge roller and a reversing roller in a continuous double-sided recording process performed by the controller of the multifunction peripheral according to the embodiment of the present disclosure.
Figure 9:
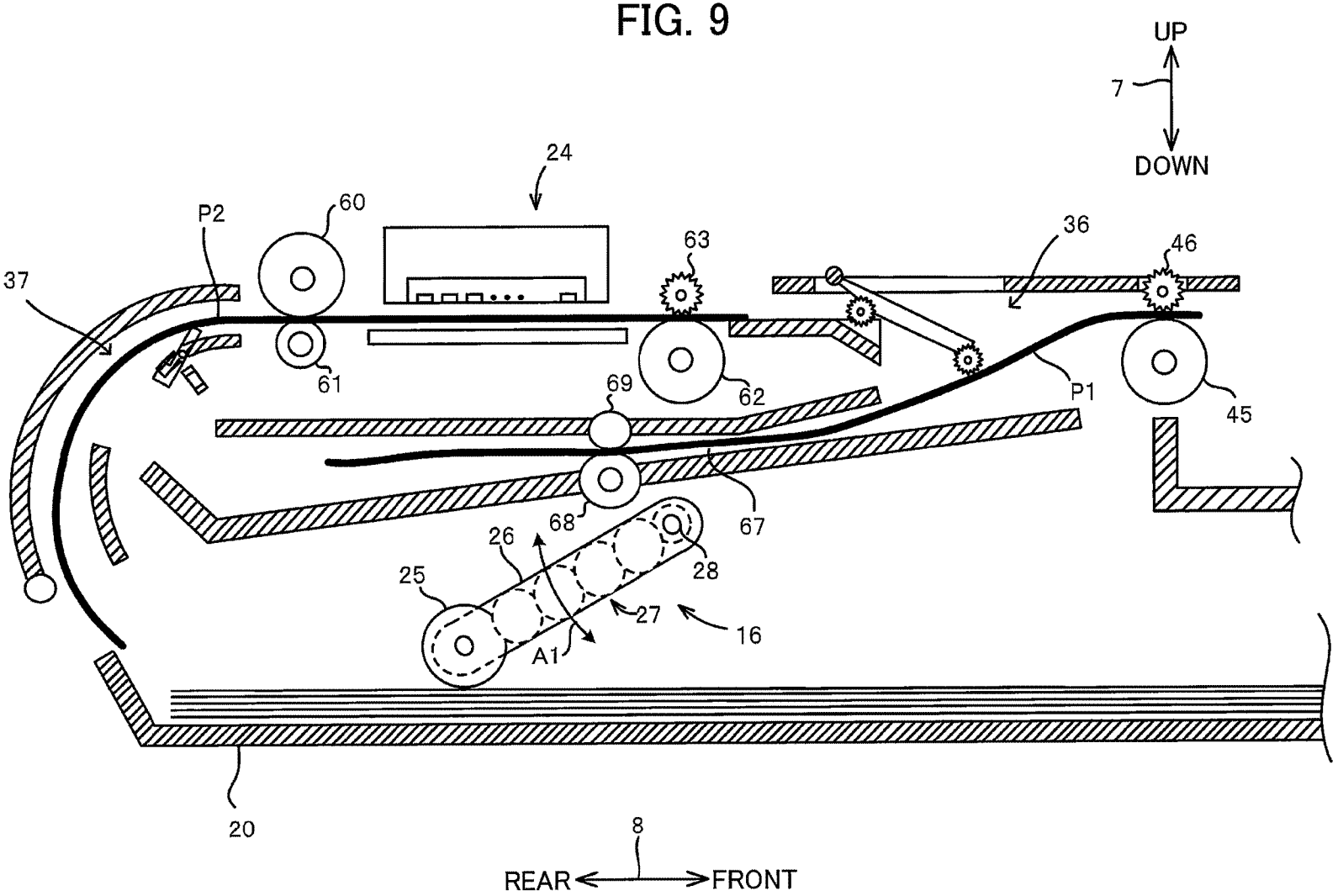
FIG. 9 is a view for description of the state of the first sheet and the second sheet in the continuous double-sided recording process.

After executing the first switching operation, the controller 130 executes a first simultaneous operation (S60). More specifically, as illustrated in FIG. 6A, the controller 130 rotates the first conveying motor 71 in the forward rotational direction and rotates the second conveying motor 72 in the reverse rotational direction. As a result, each of the conveying roller 60 and the discharge roller 62 is rotated in a rotational direction of conveying the recording sheet in the first conveying direction D1 and the reversing roller 45 is rotated in a rotational direction of conveying the recording sheet in the direction opposite to the first conveying direction D1. By rotations of these rollers 60, 62 and 45, as illustrated in FIG. 9, the first sheet P1 is conveyed along the second conveying passage 67 in the second conveying direction D2 and the second sheet P2 is conveyed along the first conveying passage 65 in the first conveying direction D1. During the first simultaneous operation, in parallel to the above control, the controller 130 controls the carriage drive motor 103 to execute a recording process to record an image on the front surface of the second sheet P2.

While performing the process of S60, the controller 130 calculates a conveyance amount of the first sheet P1 by the reversing roller 45 on the basis of a signal outputted from the second rotary encoder 75. When the controller 130 determines (or detects) using the calculated conveyance amount that a downstream end in the second conveying direction D2 of the first sheet P1 has reached a second nipping position that is a sheet nipping position between the double-sided conveying roller 68 and the follower roller 69, the controller 130 rotates the sheet-feeding motor 70 in the reverse rotational direction, thereby causing both of the reversing roller 45 and the double-sided conveying roller 68 to convey the first sheet P1 along the second conveying passage 67 in the second conveying direction D2.

After then, while performing the process of S60, the controller 130 calculates a conveyance amount of the first sheet P1 by both of the reversing roller 45 and the double-sided conveying roller 68 on the basis of signals outputted from the second rotary encoder 75 and the third rotary encoder 76 and determines using the calculated conveyance amount whether an upstream end in the second conveying direction D2 of the first sheet P1 has moved past the reversing roller 45 (S70).

When it is determined in S70 that the upstream end of the first sheet P1 has not been moved past the reversing roller 45, the controller 130 returns to S60 (S70: No). That is, the controller 130 repeats the processes of S60 and S70 until the determination is made in S70 that the upstream end of the first sheet P1 has been moved past the reversing roller 45. In this way, while repeating the processes of S60 and S70, the controller 130 rotates both of the second conveying motor 72 and the sheet-feeding motor 70 in the reverse rotational direction, thereby causing both of the reversing roller 45 and the double-sided conveying roller 68 to convey the first sheet P1 along the second conveying passage 67 in the second conveying direction D2 until the upstream end of the first sheet P1 in the second conveying direction D2 is moved past the reversing roller 45.

When the controller 130 determines (or detects) in S70 that the upstream end of the first sheet P1 in the second conveying direction D2 has been moved past the reversing roller 45 (S70: Yes), the controller 130 executes a second switching operation (S80). More specifically, the controller 130 stops rotating the first conveying motor 71 and then rotates the second conveying motor 72 in the forward rotational direction.

As described above, by rotating the second conveying motor 72 in the forward rotational direction, the first transmission gear 250 moves from the second position to the first position, and the second transmission gear 240 moves from the third position to the fourth position. Thus, as illustrated in FIG. 4, the first transmission gear 250 is brought into meshing engagement with the gear 45G, and the second transmission gear 240 is separated from the gear 45G. That is, the controller 130 executes the second switching operation to switch the first transmission portion 300 and the second transmission portion 400 to a state where the rotation driving force of the first conveying motor 71 can be transmitted to the reversing roller 45, and the rotation driving force of the second conveying motor 72 is not transmitted to the reversing roller 45. In other words, the controller 130 performs the second switching operation to switch the power transmission mechanism 200 from the second transmission state to the first transmission state.

Subsequently, the controller 130 rotates the sheet-feeding motor 70 in the reverse rotational direction to rotate the double-sided conveying roller 68, thereby conveying the first sheet P1 along the second conveying passage 67 in the second conveying direction D2 (S90). While performing the process of S90, the controller 130 calculates a conveyance amount of the first sheet P1 by the double-sided conveying roller 68 on the basis of the signal outputted from the third rotary encoder 76, and determines using the calculated conveyance amount whether the first sheet P1 has reached a standby position that is a predetermined position within the second conveying passage 67 (S100). The standby position is a position at which the first sheet P1 is located in FIG. 10. The first sheet P1 at the standby position is nipped by the double-sided conveying roller 68 and the follower roller 69 and positioned within the second conveying passage 67.

When it is determined in S100 that the first sheet P1 has not reached the standby position, the controller 130 returns to S90 (S100: No). That is, the controller 130 repeats the processes of S90 and S100 until the determination is made in S100 that the first sheet P1 has reached the standby position. In this way, while repeating the processes of S90 and S100, the controller 130 rotates the sheet-feeding motor 70 in the reverse rotational direction, thereby causing the double-sided conveying roller 68 to convey the first sheet P1 in the second conveying direction D2 until the first sheet P1 reaches the standby position.

Figure 10:
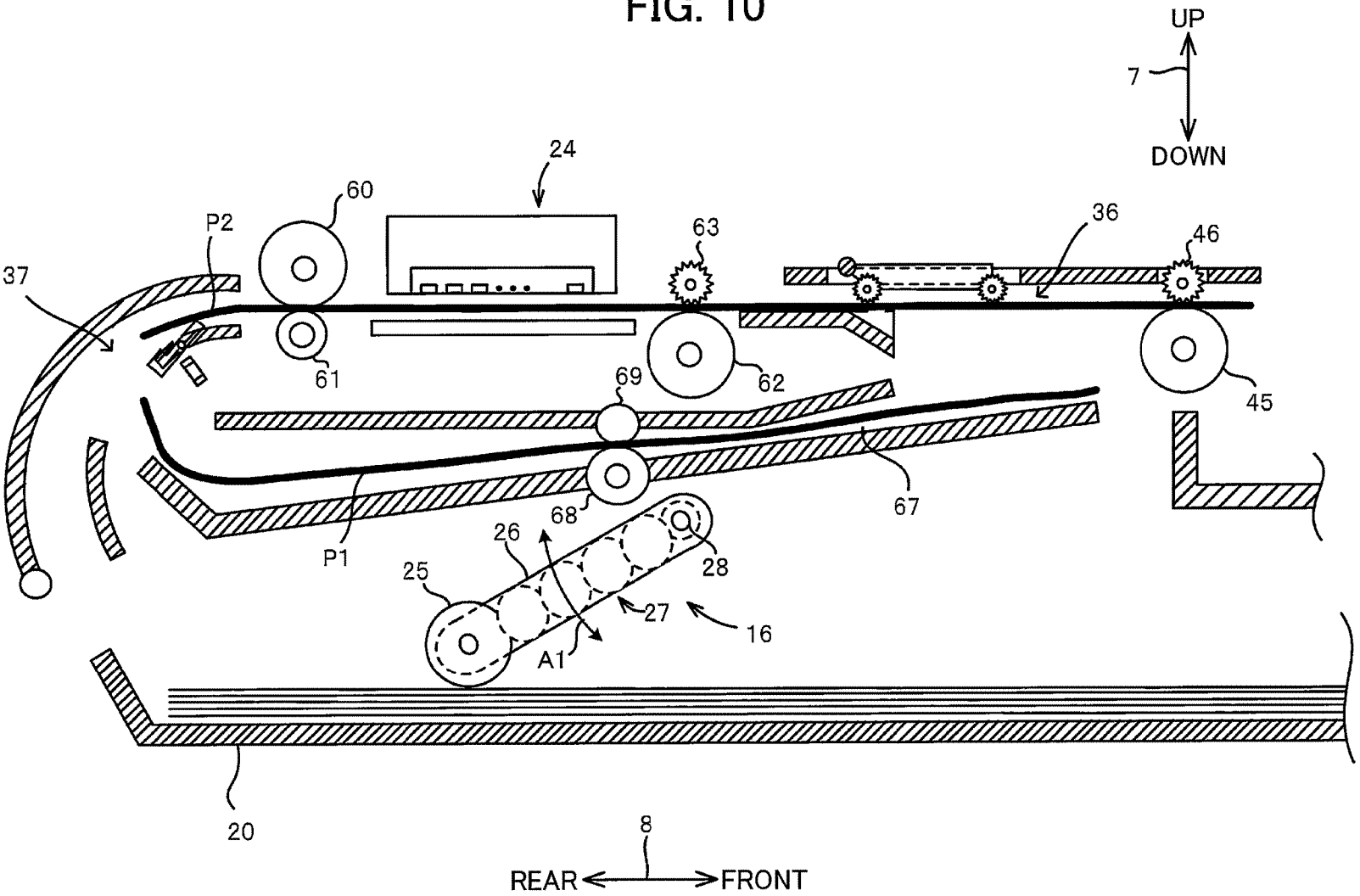
FIG. 10 is a view for description of the state of the first sheet and the second sheet in the continuous double-sided recording process.

When the controller 130 determines (or detects) in S100 that the first sheet P1 has reached the standby position (S100: Yes), the controller 130 stop rotating the sheet-feeding motor 70 to thereby stop rotating the double-sided conveying roller 68 (S110). Subsequently, as illustrated in FIG. 10, in a state where the first sheet P1 is made stand by at the standby position, i.e., in a state where the first sheet P1 is kept waiting at the standby position, the controller 130 finishes (or completes) the recording process with respect to the front surface of the second sheet P2 (S120). In other words, in S120 the controller 130 performs and finishes the recording process with respect to the front surface of the second sheet P2 using the recording portion 24 while keeping the second sheet P2 waiting within the second conveying passage 67. In the process in S120, in a state where the second sheet P2 is nipped by the conveying roller 60, the discharge roller 62 and the reversing roller 45 as illustrated in FIG. 10, the image is recorded on the front surface of the second sheet P2. That is, while the second sheet P2 is conveyed along the first conveying passage 65 in the first conveying direction D1 by the conveying roller 60, the discharge roller 62 and the reversing roller 45, the image is recorded on the front surface of the second sheet P2. In other words, the controller 130 records the image on the front surface of the second sheet P2 using the recording portion 24 while conveying the second sheet P2 along the first conveying passage 65 in the first conveying direction D1 by rotating the conveying roller 60, the discharge roller 62, and the reversing roller 45 by driving the first conveying motor 71.

In the present embodiment, the second switching operation is executed in S80. Therefore, when the controller 130 executes the process in S120, the conveying roller 60, the discharge roller 62 and the reversing roller 45 are rotated by transmission of the rotation driving force of the first conveying motor 71 from the same. That is, the three rollers, namely, the conveying roller 60, the discharge roller 62 and the reversing roller 45 are rotated by the driving force of the single motor (i.e., the first conveying motor 71). Accordingly, a conveyance amount in the first conveying direction D1 of the second sheet P2 during the execution of the recording process to the second sheet P2 does not differ between the above three rollers. Consequently, the second sheet P2 can be conveyed with high conveyance accuracy, thereby suppressing disturbance of the image recorded on the front surface of the second sheet P2.

After completion of the recording process to the front surface of the second sheet P2, in the state where the first sheet P1 is made stand by at the standby position, the controller 130 rotates the first conveying motor 71 in the forward rotational direction to cause the conveying roller 60, the discharge roller 62 and the reversing roller 45 to further convey the second sheet P2 in the first conveying direction D1 (S130). Similar to S40, while performing the process of S130, the controller 130 determines whether a trailing end (i.e., an upstream end in the first conveying direction D1) of the second sheet P2 has been moved to (or reached) the branching portion 36 by the process of S130 (S140).

When it is determined in S140 that the trailing end of the second sheet P2 has not been moved to the branching portion 36, the controller 130 returns to S130 (S140: No). That is, the controller 130 repeats the processes of S130 and S140 until the determination is made in S140 that the trailing end of the second sheet P2 has been moved to the branching portion 36. In this way, while repeating the processes of S130 and S140, the controller 130 rotates the first conveying motor 71 in the forward rotational direction to rotate the conveying roller 60, the discharge roller 62 and the reversing roller 45, thereby conveying the second sheet P2 along the first conveying passage 65 in the first conveying direction D1 until the trailing end of the second sheet P2 reaches the branching portion 36.

Figure 11:
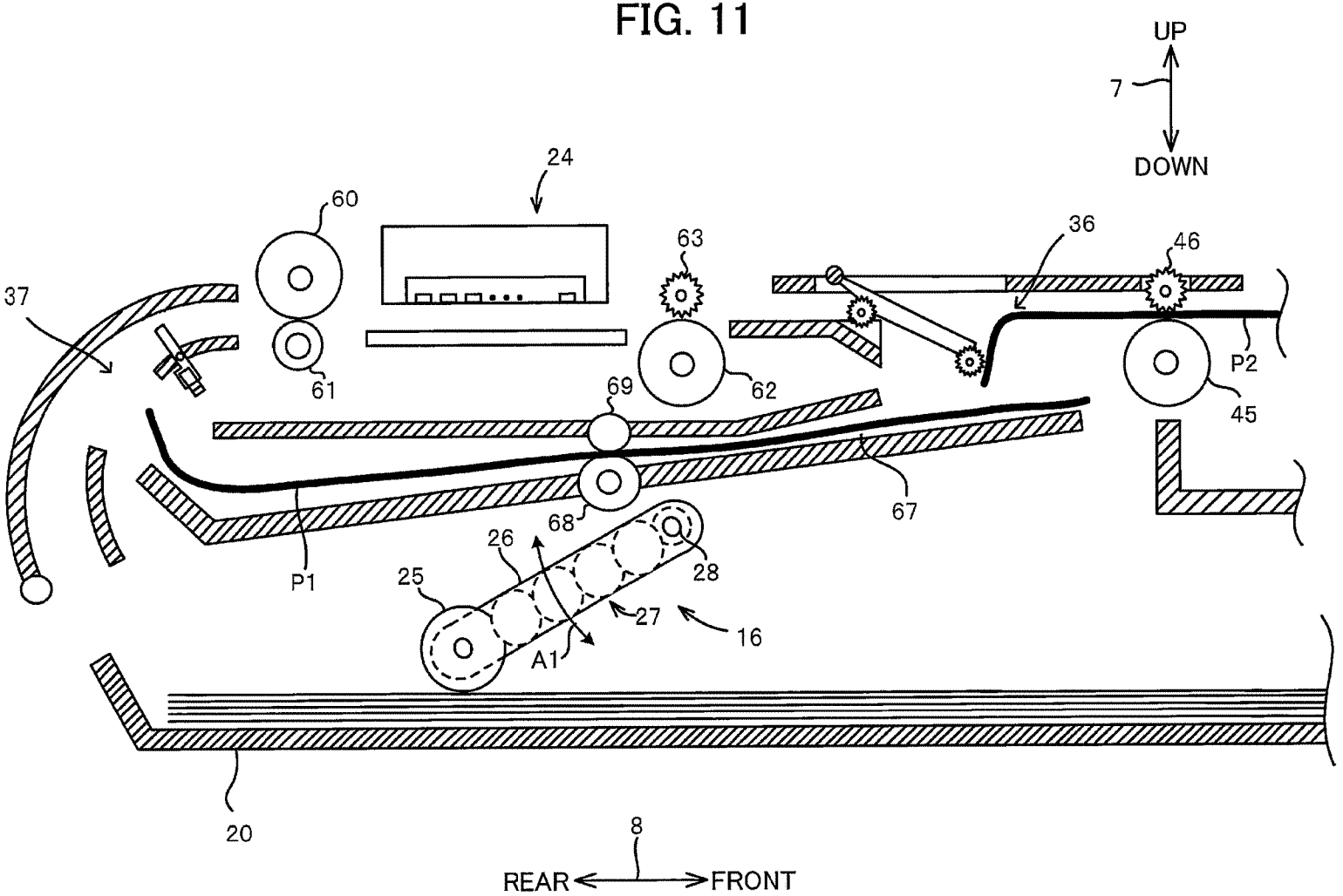
FIG. 11 is a view for description of the state of the first sheet and the second sheet in the continuous double-sided recording process.

As illustrated in FIG. 11, when the controller 130 determines (or detects) that detecting that the trailing end of the second sheet P2 has been conveyed to the branching portion 36 (S140: YES), the controller 130 executes the first switching operation (S150). The first switching operation in S150 is the same as the first switching operation in S50. This first switching operation switches the power transmission mechanism 200 from the first transmission state to the second transmission state.

Figure 6B:
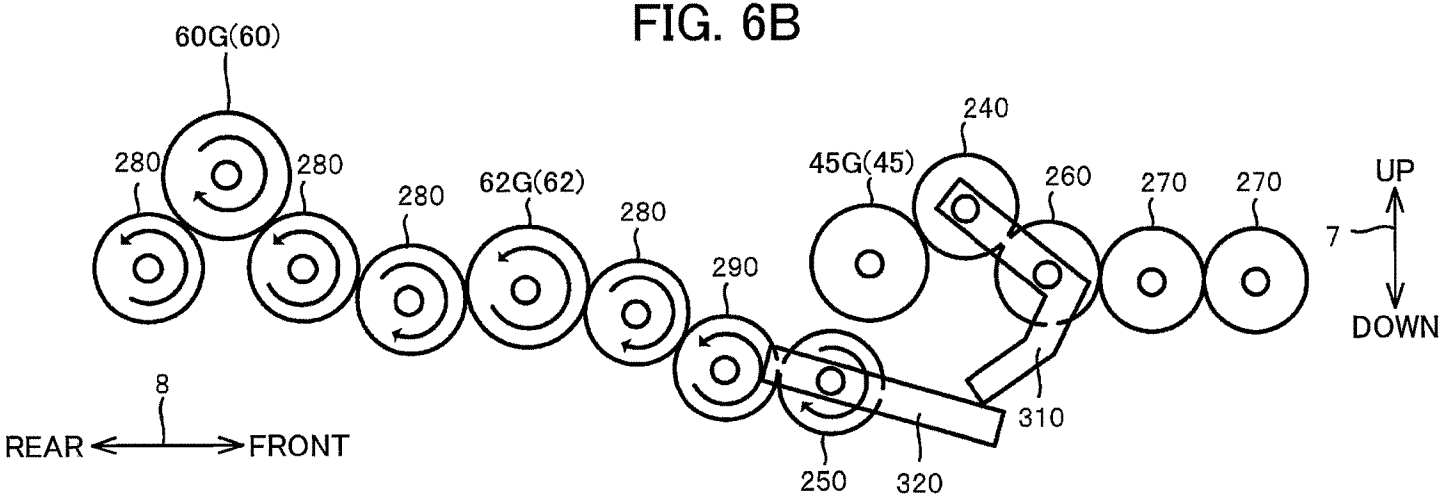
FIG. 6B is a view for description of the power transmission state of the conveyer roller, the discharge roller and the reversing roller in the continuous double-sided recording process.
Figure 12:
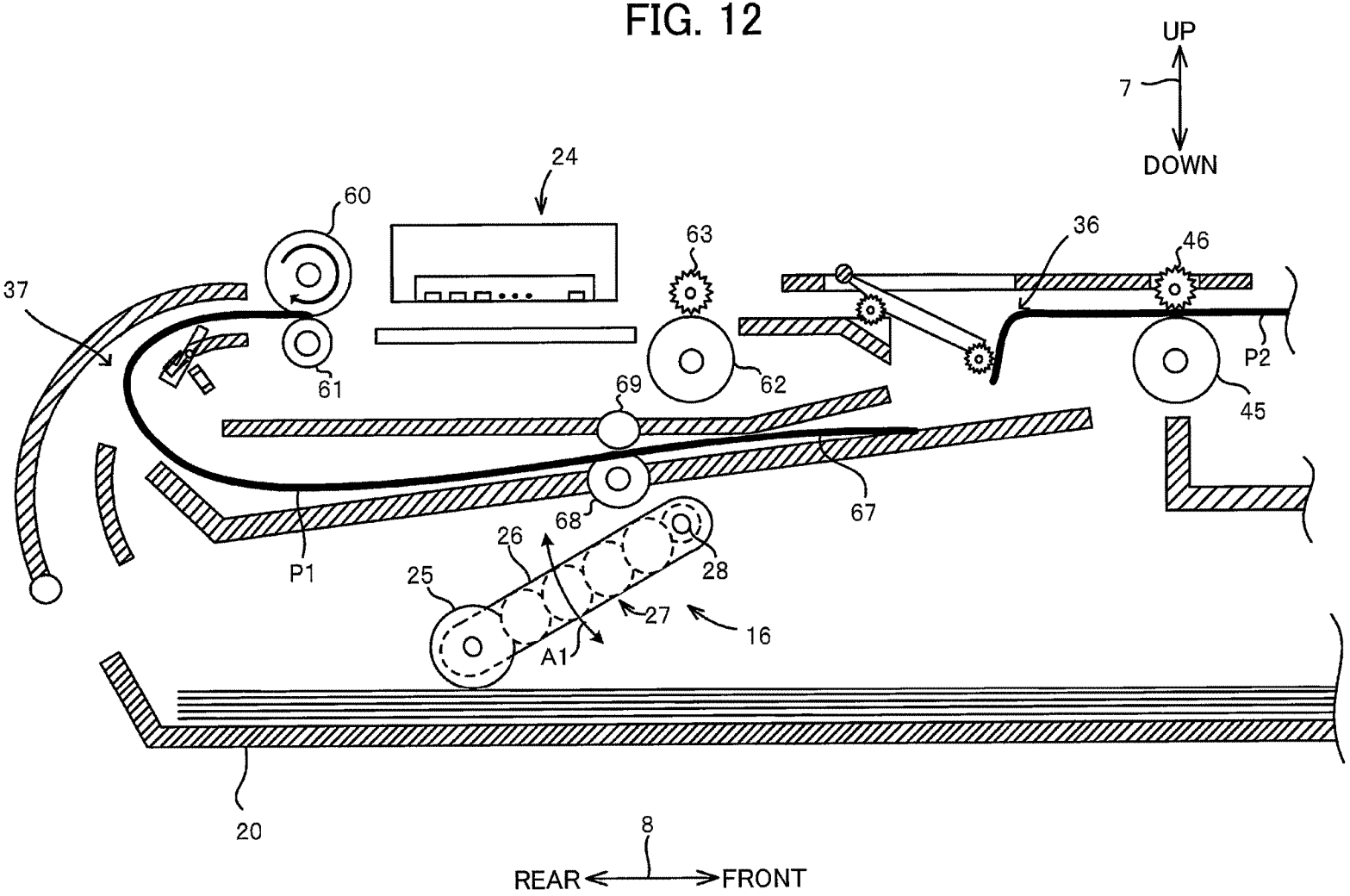
FIG. 12 is a view for description of the state of the first sheet and the second sheet in the continuous double-sided recording process.

After performing the first switching operation in S150, the controller 130 executes a registration operation to the first sheet P1 (S160). More specifically, the controller 130 rotates the first conveying motor 71 in the reverse rotational direction by a predetermined rotation amount with the second conveying motor 72 stopped. In a reverse rotation period during which the first conveying motor 71 rotates in the reverse rotational direction by the predetermined rotation amount, the controller 130 rotates the sheet-feeding motor 70 in the reverse rotational direction to rotate (or drive) the double-sided conveying roller 68, thereby conveying the first sheet P1 to the first nipping position via the joining portion 37. As illustrated in FIG. 6B, the reverse rotation of the first conveying motor 71 causes the conveying roller 60 to rotate in a rotational direction of conveying the recording sheet in the direction opposite to the first conveying direction D1. Therefore, as illustrated in FIG. 12, the first sheet P1 conveyed to the first nipping position is abutted on the conveying roller 60 that is rotating in the rotational direction of conveying the recording sheet in the direction opposite to the first conveying direction D1. By this abutment of the first sheet P1 against the rotating conveying roller 60, diagonally feeding of the first sheet P1 can be corrected, thereby enabling to convey the first sheet P1 with a stable posture in the first conveying direction D1.

Note that, during the reverse rotation period, since the controller 130 keeps the second conveying motor 72 stopped, the reversing roller 45 does not rotate and remains stopped. Accordingly, during the reverse rotation period, i.e., during the registration operation, the second sheet P2 is kept waiting in the state where the trailing end of the second sheet P2 in the first conveying direction D1 is positioned at the branching portion 36.

Figure 13:
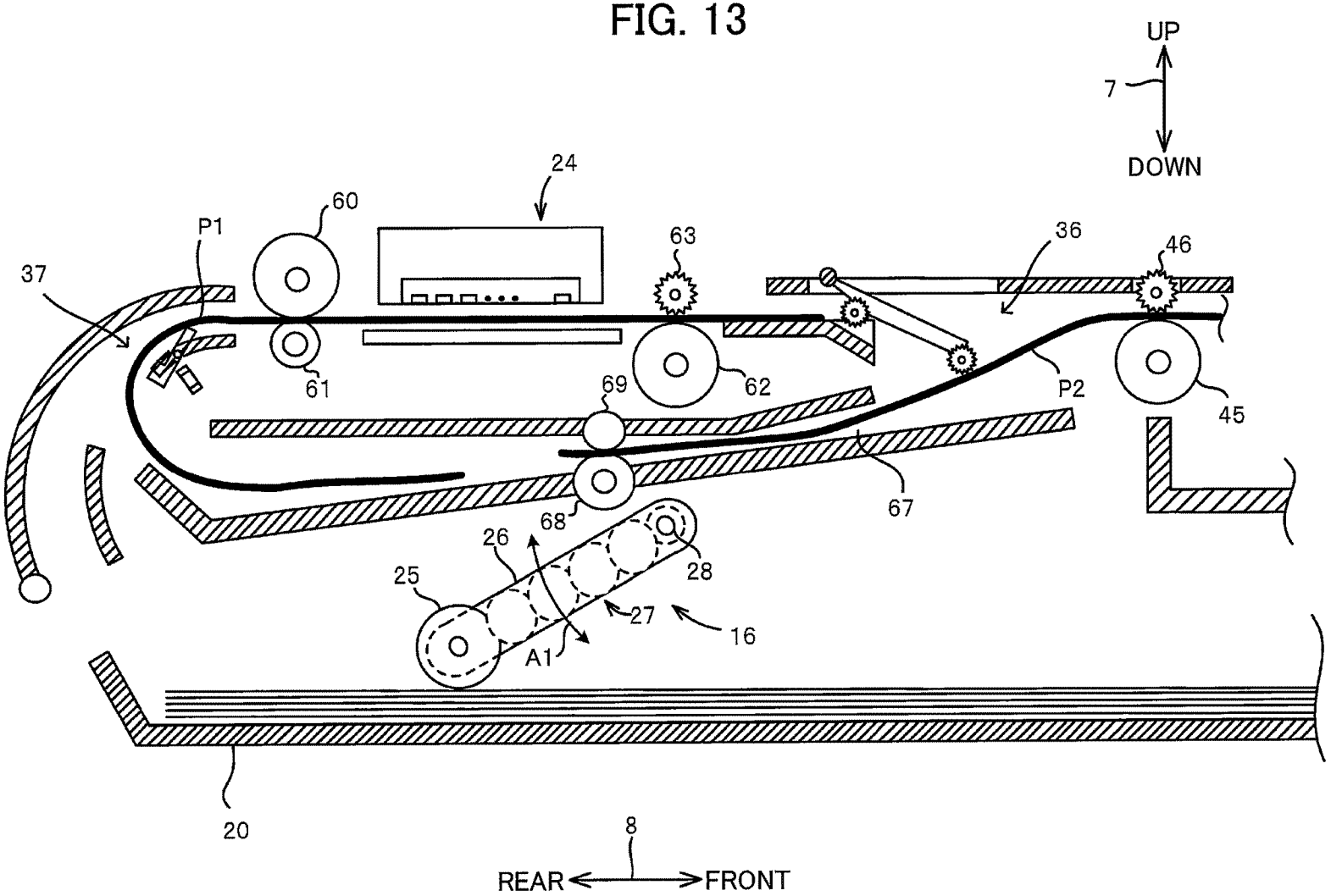
FIG. 13 is a view for description of the state of the first sheet and the second sheet in the continuous double-sided recording process.

After completion of the registration operation, the controller 130 executes a second simultaneous operation (S170). More specifically, the controller 130 rotates the first conveying motor 71 in the forward rotational direction and rotates the second conveying motor 72 in the reverse rotational direction. Thus, as illustrated in FIG. 13, while the second sheet P2 is conveyed along the second conveying passage 67 in the second conveying direction D2, the first sheet P1 is conveyed in the first conveying direction D1. In the second simultaneous operation, in parallel to the above conveyance, the controller 130 controls the carriage drive motor 103 to move the carriage 40, thereby causing the recording portion 24 to record an image on a back surface of the first sheet P1.

Subsequently, the controller 130 conveys the second sheet P2 in the second conveying direction D2 until an upstream end in the second conveying direction D2 of the second sheet P2 is moved past the reversing roller 45 (S180: NO). When it is determined (or detected) that the upstream end in the second conveying direction D2 of the second sheet P2 has been moved past the reversing roller 45 (S180: YES), the controller 130 performs the second switching operation (S190). The second switching operation in S190 is the same as the second switching operation in S80. This second switching operation switches the power transmission mechanism 200 from the second transmission state to the first transmission state.

Figure 14:
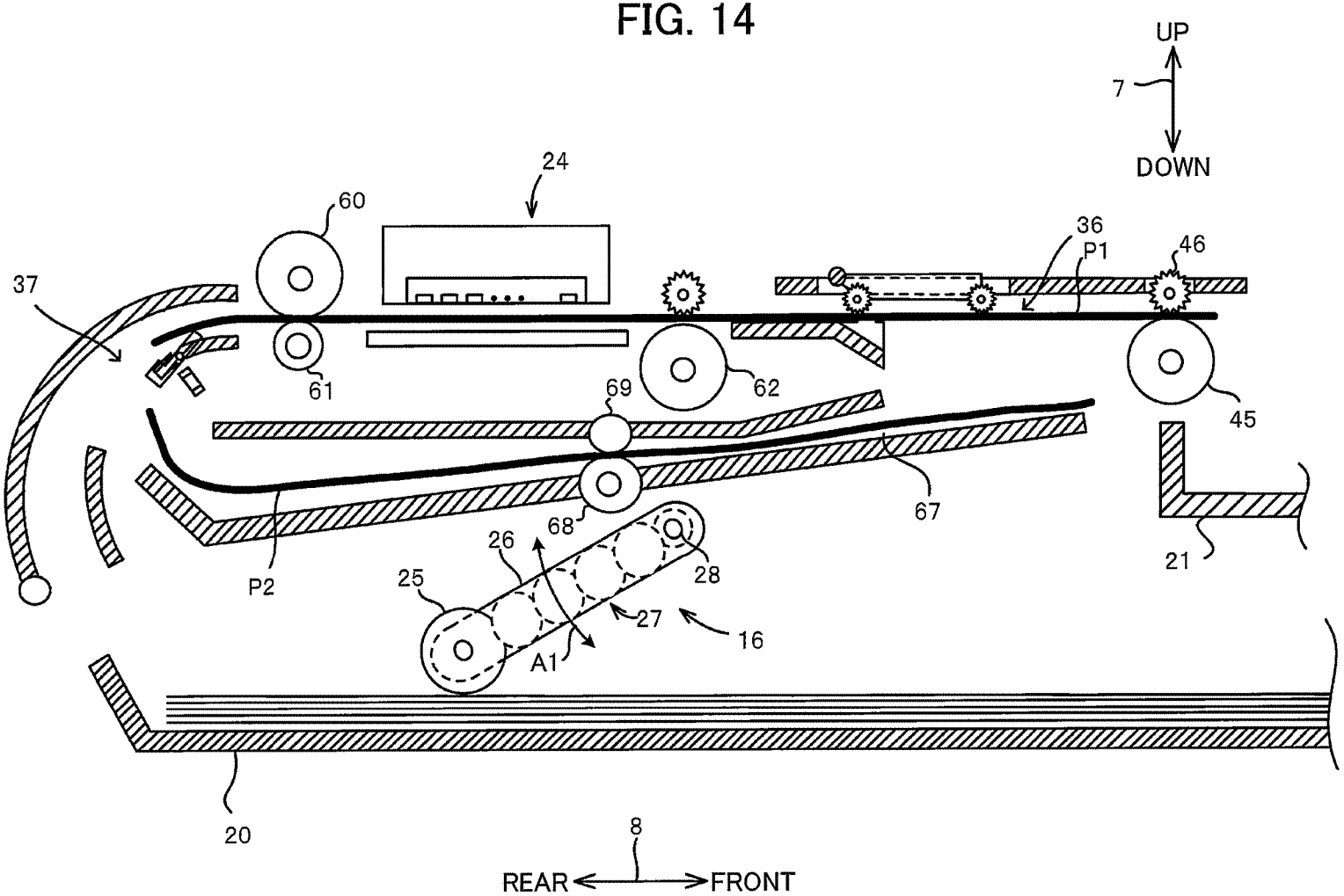
FIG. 14 is a view for description of the state of the first sheet and the second sheet in the continuous double-sided recording process.

After performing the second switching operation, the controller 130 rotates the sheet-feeding motor 70 in the reverse rotational direction to cause the double-sided conveying roller 68 to convey the second sheet P2 in the second conveying direction D2 (S200). Until the second sheet P2 reaches the standby position on the second conveying passage 67, the controller 130 conveys the second sheet P2 in the second conveying direction D2 (S210: NO). When it is determined (or detected) that the second sheet P2 has reached the standby position as illustrated in FIG. 14 (S210: YES), the controller 130 stops rotating the sheet-feeding motor 70 to stop rotating the double-sided conveying roller 68 (S220).

Figure 15:
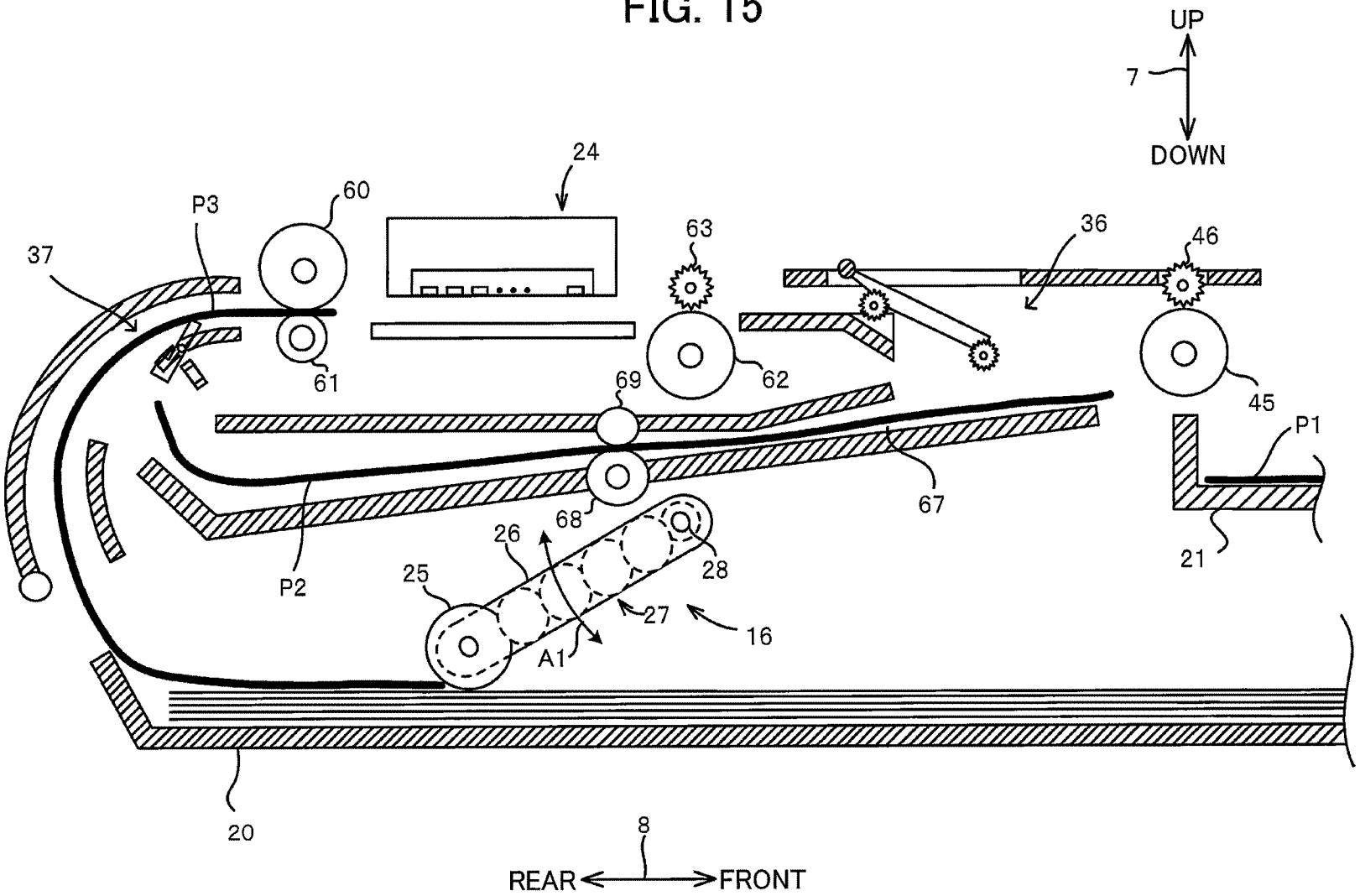
FIG. 15 is a view for description of a state of the first sheet, the second sheet, and a third sheet in the continuous double-sided recording process.
Figure 16:
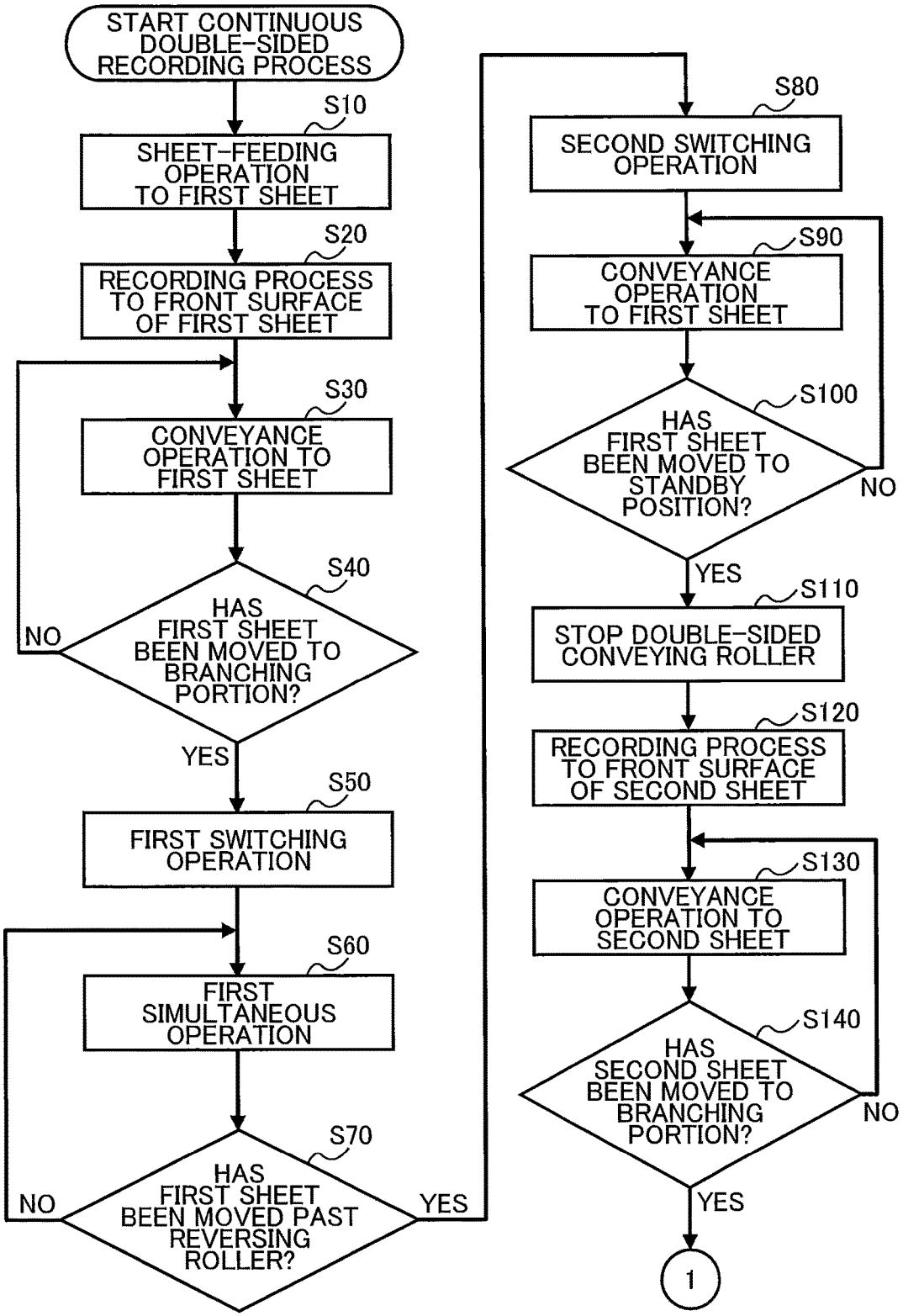
FIG. 16 is a first part of flowchart illustrating the continuous double-sided recording process.

The controller 130 determines whether there is an image to be recorded on a next sheet (S230). When it is determined that there is the image to be recorded on the next sheet (S320: YES), the controller 130 executes a third simultaneous operation (S280). More specifically, the controller 130 rotates the first conveying motor 71 to cause the conveying roller 60, the discharge roller 62 and the reversing roller 45 to convey the first sheet P1 in the first conveying direction D1. While performing the conveyance of the first sheet P1, the controller 130 rotates the carriage drive motor 103 to cause the recording portion 24 to record an image on the back surface of the first sheet P1, and then performs a discharge operation to discharge the first sheet P1 to the discharge tray 21. In parallel to the recording and discharging with respect to the first sheet P1, the controller 130 rotates the sheet-feeding motor 70 in the forward rotational direction to feed (or supply) a third sheet P3 from the sheet supply tray 20 to the first nipping position (see FIG. 15). In the third simultaneous operation, the controller 130 stops the rotation of the double-sided conveying roller 68, thereby causing the second sheet P2 to stand by at the standby position as illustrated in FIG. 15.

Subsequently, the controller 130 performs a recording process to record an image on the surface of the third sheet P3 in a state where the second sheet P2 is made stand by at the standby position (S290). Upon finishing the recording process to the third sheet P3, the controller 130 further conveys the third sheet P3 in the first conveying direction D1 (S300). Until an upstream end in the first conveying direction D1 of the third sheet P3 reaches the branching portion 36, the controller 130 conveys the third sheet P3 in the first conveying direction D1 (S310: NO). When it is determined (or detected) that the upstream end in the first conveying direction D1 of the third sheet P3 has been conveyed to the branching portion 36 (S310: YES), the controller 130 returns to the process in S160. In the processes after returning to S160, the second sheet P2 corresponds to "first sheet" appearing in the flowchart, and the third sheet P3 corresponds to "second sheet" appearing in the flowchart.

On the other hand, when there is no image to be recorded on the next sheet in S230 (S230: NO), an image is recorded on the back surface of the first sheet P1 in a state where the second sheet P2 is kept waiting at the standby position within the second conveying passage 67 as illustrated in FIG. 14 (S240). Then, the first sheet P1 is discharged to the discharge tray 21 (S250). Subsequently, an image is recorded on the back surface of the second sheet P2 (S260), and the second sheet P2 is discharged to the discharge tray 21 subsequent to the first sheet P1 (S270). After then, rotations of all motors is stopped to finish the continuous double-sided recording process.

<Technical Advantages of The Present Embodiment>

According to the present embodiment, in the image recording in which an image is recorded on the recording sheet by the recording portion 24 while the recording sheet is conveyed in the first conveying direction D1, the rotation driving force of the first conveying motor 71 is transmitted to the conveying roller 60, the discharge roller 62 and the reversing roller 45, thereby causing these rollers to rotate. Consequently, the recording sheet can be conveyed in the first conveying direction D1 by each roller providing the same conveyance amount, thereby suppressing disturbance of the image recorded on the recording sheet by the recording portion 24. In an operation in which the conveying roller 60 and the discharge roller 62 convey one of the first sheet P1 and the second sheet P2 in the first conveying direction D1 while the reversing roller 45 conveys the remaining one sheet of the first sheet P1 and the second sheet P2 in the second conveying direction D2, the rotation driving force of the second conveying motor 72 is transmitted to the reversing roller 45, thereby causing the same to rotate. Consequently, the reversing roller 45 can be rotated dependently of the rotations of the conveying roller 60 and the discharge roller 62. As a result, a timing of rotating the reversing roller 45 is not restricted, and a speed up of the continuous double-sided recording processing can be achieved.

In the present embodiment, when the controller 130 determines in S70 that the upstream end of the first sheet P1 in the second conveying direction D2 has been moved past the reversing roller 45 (S70: Yes), the controller 130 switches the power transmission mechanism 200 from the second transmission state to the first transmission state. With this configuration, in a case where the controller 130 rotates the conveying roller 60, the discharge roller 62, and the reversing roller 45 to convey the second sheet P2 subsequent to the first sheet P1 in the first conveying direction D1, the controller 130 can rotate these three rollers 60, 62, and 45 by driving the first conveying motor 71.

In the present embodiment, the length in the second conveying direction D2 of the second conveying passage 67 is longer than a length in the second conveying direction D2 of the recording sheet of the maximum size. In other words, the second conveying passage 67 is longer than a length along the second conveying passage 67 of the recording sheet of the maximum size. With this configuration, the controller 130 can perform the recording process with respect to the front surface of the second sheet P2 while keeping the first sheet P1 waiting within the second conveying passage 67.

According to the present embodiment, the first sheet P1 can be abutted on the conveying roller 60 that is being rotated in the clockwise direction of FIG. 2 (i.e., in the rotational direction of conveying the recording sheet in the direction opposite to the first conveying direction D1). With this abutment, diagonally feeding of the first sheet P1 can be corrected before the back surface thereof is recorded by the recording portion 24.

In the present embodiment, during the time period for which the first sheet P1 is abutted on the conveying roller 60, the second sheet P2 is kept waiting at the branching portion 36 so as to be prevented from being conveyed along the second conveying passage 67 in the second conveying direction D2. With this configuration, a jamming caused by contact of the second sheet P2 with the first sheet P1 can be prevented from occurring.

In the present embodiment, the second sheet P2 has already been supplied (or fed) to the conveying roller 60 when the upstream end of the first sheet P1 in the first conveying direction D1 reaches the branching portion 36. Accordingly, speeding up of the continuous double-sided recording process can be achieved.

In the present embodiment, the power transmission mechanism 200 can be switched between the first transmission state and the second transmission state by switching the rotational direction of the second conveying motor 72 between the forward rotational direction and the reverse rotational direction. With this configuration, no driving source exclusively used for the switching of the power transmission mechanism 200 needs to be provided. Accordingly, reductions in the number of parts, in cost, and in size of the image recording apparatus can be achieved.

In the present embodiment, by rotation of the second conveying motor 72, the first transmission gear 250 is moved between the first position and the second position and the second transmission gear 240 is moved between the third position and the fourth position. Further, by the movements of the first transmission gear 250 and the second transmission gear 240, the power transmission mechanism 200 is switched between: the state where the driving force of the first conveying motor 71 can be transmitted to the reversing roller 45; and the state where the driving force of the second conveying motor 72 can be transmitted to the reversing roller 45. Accordingly, the power transmission mechanism 200 can be switched between the first transmission state and the second transmission state by switching the rotational direction of the second conveying motor 72.

In the present embodiment, during the movement of the second transmission gear 240 from the fourth position to the third position, the second movement member 310 abuts on the first movement member 320. By this abutment, the first transmission gear 250 can be moved from the first position to the second position in conjunction with the movement of the second transmission gear 240 from the fourth position to the third position.

In the present embodiment, the power transmission mechanism 200 includes the coil spring 330 urging the first transmission gear 250 in the direction from the second position toward the first position. By virtue of the urging force of the coil spring 330, the first transmission gear 250 can be securely moved from the second position to the first position.

Although description has been made to the embodiments of the present disclosure, the present invention is not limited to the above-described embodiments but may be embodied in various modifications and improvements based on knowledge of those skilled in the art.

<First Modification>

In the present embodiment, the second movement member 310 presses the first movement member 320 to thereby move the first transmission gear 250 from the first position to the second position, and the urging force of the coil spring 330 moves the first transmission gear 250 from the second position to the first position. However, as illustrated in FIGS. 19A and 19B, a third movement member which retains both of the first transmission gear 250 and the second transmission gear 240 may be provided.

Figure 19A:
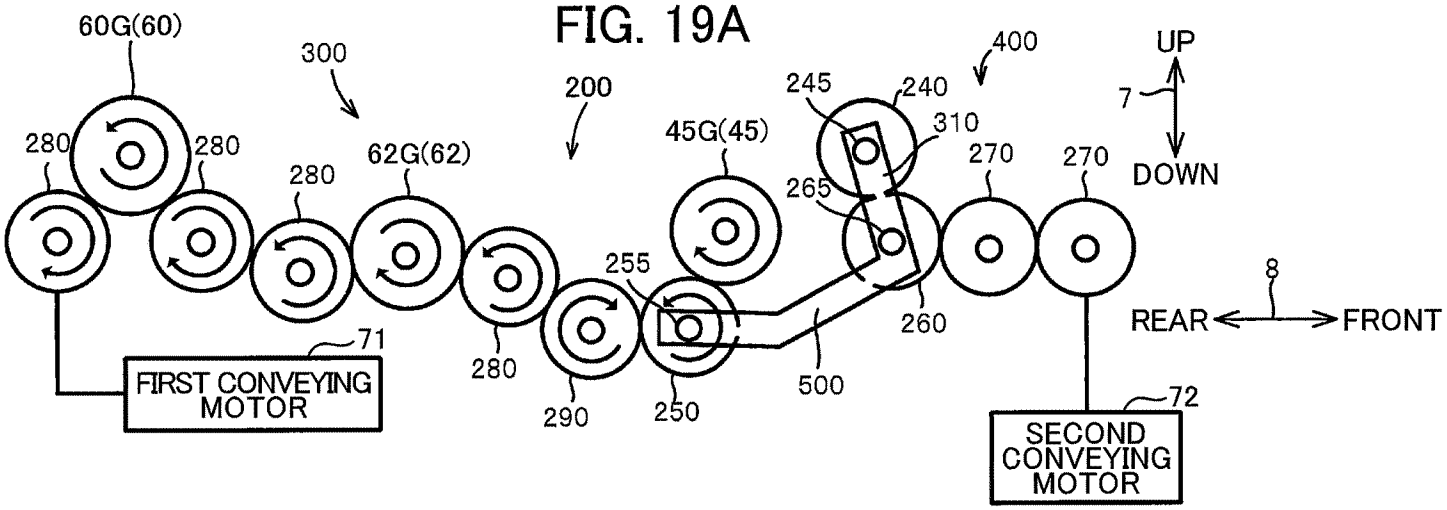
FIG. 19A is a view for description of a first transmission portion and a second transmission portion according to a first modification of the embodiment of the present disclosure.
Figure 19B:
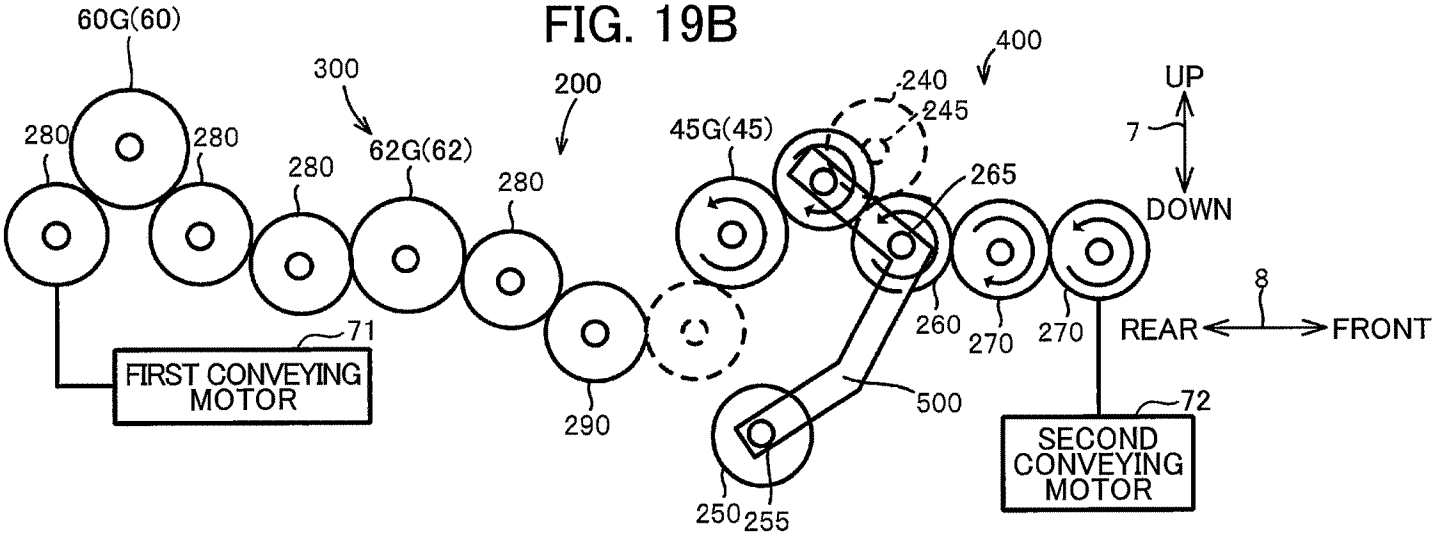
FIG. 19B is a view for description of the first transmission portion and the second transmission portion according to the first modification of the embodiment of the present disclosure.

In a first modification illustrated in FIGS. 19A and 19B, a third movement member 500 which retains both of the first transmission gear 250 and the second transmission gear 240 is provided, and movement of the first transmission gear 250 between the first position and the second position is performed by pivotal movement of the third movement member 500. The third movement member 500 is coupled to both of the rotation shaft 255 of the first transmission gear 250 and the rotation shaft 245 of the second transmission gear 240, thereby retaining the first transmission gear 250 and the second transmission gear 240. The third movement member 500 is coupled to the rotation shaft 265 of the gear 260 so as to be pivotally movable about the rotation shaft 265. As illustrated in FIG. 19A, when the second transmission gear 240 is located at the fourth position, the third movement member 500 retains the first transmission gear 250 at the first position. When the second transmission gear 240 moves from the fourth position to the third position, the third movement member 500 pivotally moves about the rotation shaft 265. As a result, as illustrated in FIG. 19B, the third movement member 500 retains the first transmission gear 250 at a position (i.e., the second position) spaced away from the gear 45G. Thus, the first modification can move the first transmission gear 250 by a simple configuration, and consequently can realize reduction in the number of parts and reduction in cost.

<Second Modification>

In the present embodiment, the coil spring 330 urges the first movement member 320 upward, thereby urging the first transmission gear 250 from the second position toward the first position. However, as illustrated in FIGS. 20A and 20B, there may be provided a solenoid configured to urge the first movement member 320 upward.

Figure 20A:
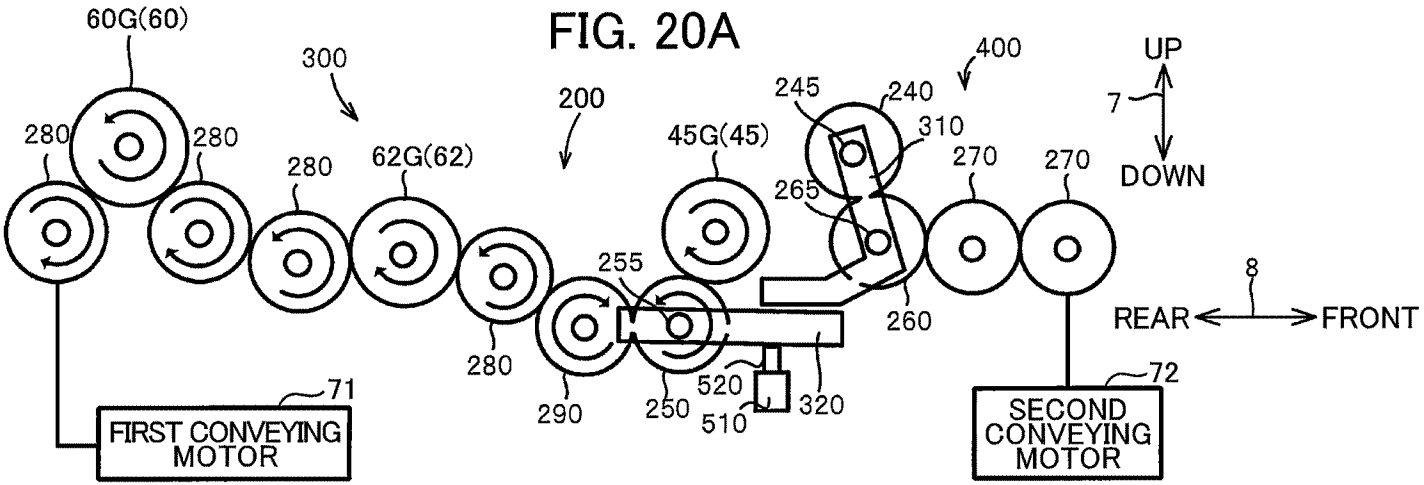
FIG. 20A is a view for description of a first transmission portion and a second transmission portion according to a second modification of the embodiment of the present disclosure.
Figure 20B:
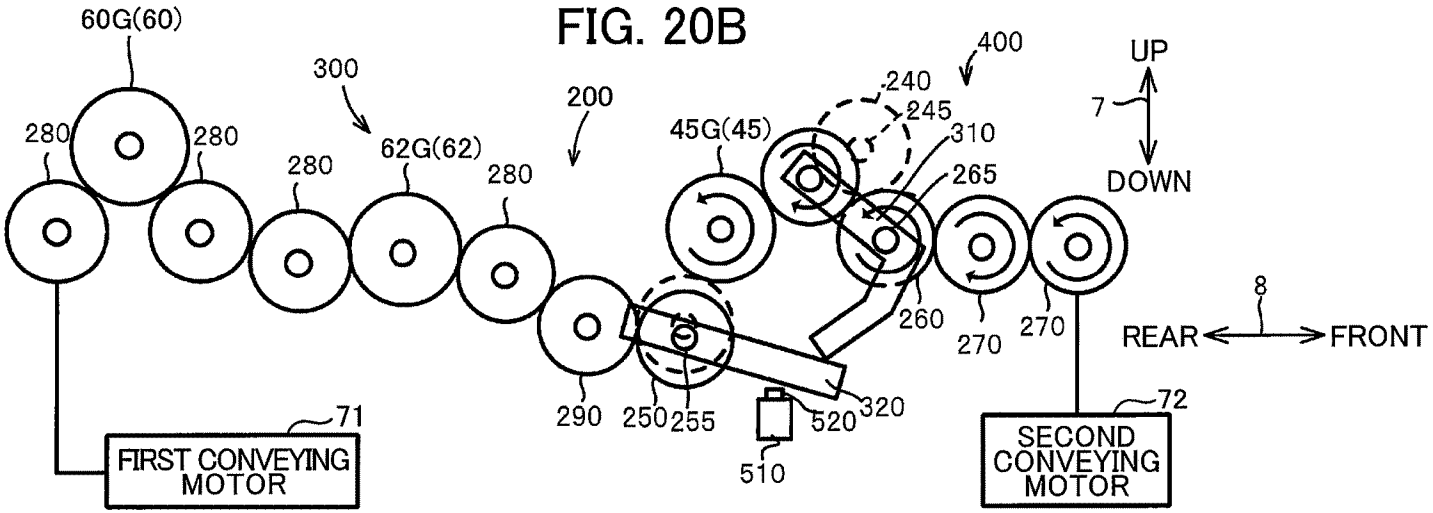
FIG. 20B is a view for description of the first transmission portion and the second transmission portion according to the second modification of the embodiment of the present disclosure.

A second modification illustrated in FIGS. 20A and 20B is provided a solenoid 510 that is a known solenoid. The solenoid 510 includes a movable body 520 and an electromagnetic coil. The movable body 520 is linearly moved in the up-down direction 7 by a magnetic force produced when a current flows through the electromagnetic coil. In a state where the first movement member 320 is pressed downward by the second movement member 310 as illustrated in FIG. 20A, when the solenoid 510 is driven to retract the movable body 520 from the first movement member 320, the first movement member 320 is pushed down by the second movement member 310. As a result, the first transmission gear 250 is moved from the first position to the second position. On the other hand, in a state where the second transmission gear 240 is located at the third position as illustrated in FIG. 20B, when the solenoid 510 is driven to protrude the movable body 520 upward, the movable body 520 is abutted on the first movement member 320 to press the first movement member 320 upward. As a result, the first transmission gear 250 is moved from the second position to the first position. In this way, even in a case where the solenoid 510 is employed, the first transmission gear 250 can be moved between the first position and the second position and the second transmission gear 240 can be moved between the third position to the fourth position.

<Third Modification>

In the present embodiment, the second transmission gear 240 of the second transmission portion 400 is moved from the fourth position to the third position by rotating the second conveying motor 72 in the reverse rotational direction, and is moved from the third position to the fourth position by rotating the second conveying motor 72 in the forward rotational direction. However, the rotational direction of the second conveying motor 72 for moving the second transmission gear 240 between the third position and the fourth position is not limited to this. That is, by changing the number of gears transmitting the rotation driving force of the second conveying motor 72 to the second transmission gear 240, there may be employed a configuration in which the second transmission gear 240 is moved from the fourth position to the third position by the forward rotation of the second conveying motor 72 and is moved from the third position to the fourth position by the reverse rotation of the second conveying motor 72.

<Fourth Modification>

In the present embodiment, the positions of the first transmission gear 250 and the second transmission gear 240 are moved by the rotation of the second conveying motor 72. However, the first transmission gear 250 and the second transmission gear 240 may be moved by a driving source other than the second conveying motor 72.

For example, the first transmission gear 250 may be a planetary gear similar to the second transmission gear 240. In this case, the first transmission gear 250 may be movable between the first position and the second position by the forward and reverse rotations of the first conveying motor 71. Further, the third movement member 500 described in the first modification may be employed, and the second transmission gear 240 may be moved between the third position and the fourth position in conjunction with movement of the first transmission gear 250 when rotating the first conveying motor 71. There may be provided a driving motor exclusively used for pivotally moving the third movement member 500 described in the first modification, and the first transmission gear 250 and the second transmission gear 240 may be moved by pivotally moving the third movement member 500 by rotating the exclusively used driving motor.

<Fifth Modification>

In the present embodiment, the coil spring 330 is configured to urge the first movement member 320. Alternatively, the first movement member 320 may be configured to be urged by an elastic rubber or a leaf spring.

<Sixth Modification>

In the present embodiment, the second movement member 310 is coupled to the rotation shaft 265 of the gear 260, and is pivotally movable about the rotation shaft 265. However, the second movement member 310 need not necessarily be coupled to the rotation shaft 265. For example, the second movement member 310 may be attached to the frame of the printing portion 11 so as to be pivotally movable about a portion coupled to the frame. Even in this configuration, the second movement member 310 can be pivotally moved in conjunction with the movement of the second transmission gear 240 from the fourth position to the third position, thereby enabling to press the first movement member 320 and move the first transmission gear 250 from the first position to the second position.

<Seventh Modification>

In the present embodiment, the continuous double-sided recording process of recording images on both surfaces of each of the plurality of recording sheets has been described as the process executed by the controller 130. The process executed by the controller 130 is not limited to this. For example, when the controller 130 is configured to perform a single-sided recording process of recording an image only on one surface for each of the plurality of recording sheets, the controller 130 may be execute a continuous reversing recording process in order for the recording sheets to be discharged to the discharge tray 21 with their image-recorded surfaces facing downward. In the continuous reversing recording process, the plurality of recording sheets each having one surface on which an image has been recorded are conveyed to the second conveying passage 67 and then are discharged with their front and back sides reversed. Further, the controller 130 may be configured to execute a recording process which is a combination of the continuous reversing recording process and the continuous double-sided recording process.

<Eighth Modification>

In the present embodiment, the rotation driving force of the sheet-feeding motor 70 drives the double-sided conveying roller 68. However, the driving source for driving the double-sided conveying roller 68 is not limited to the sheet-feeding motor 70. For example, a driving transmission portion (not illustrated) constituted by a plurality of gears may transmit the rotation driving force of the second conveying motor 72 to the double-sided conveying roller 68 to thereby drive the same. In this case, by configuring the driving transmission portion to reversely rotate the double-sided conveying roller 68 not only when the second conveying motor 72 rotates in the forward rotational direction but also when the second conveying motor 72 rotates in the reverse rotational direction, the controller 130 can execute the continuous double-sided recording process described in the present embodiment.

What is claimed is:

1. An image recording apparatus comprising:

a first conveying passage along which a first recording medium and a second recording medium are configured to be conveyed in a first conveying direction;

a recording portion provided at the first conveying passage, the recording portion being configured to record an image on each of the first recording medium and the second recording medium;

a second conveying passage branched from the first conveying passage at a branching portion and joining the first conveying passage at a joining portion, the branching portion being positioned downstream of the recording portion in the first conveying direction, the joining portion being positioned upstream of the recording portion in the first conveying direction, the first recording medium and the second recording medium being configured to be conveyed along the second conveying passage in a second conveying direction from the branching portion toward the joining portion;

a first conveying roller provided at the first conveying passage and positioned downstream of the joining portion in the first conveying direction;

a second conveying roller provided at the first conveying passage and positioned downstream of the branching portion in the first conveying direction;

a first motor configured to provide a first driving force;

a second motor configured to provide a second driving force;

a power transmission mechanism capable of being switched between a first state and a second state, the power transmission mechanism in the first state being configured to transmit the first driving force to both the first conveying roller and the second conveying roller, the power transmission mechanism in the second state being configured to transmit the first driving force to the first conveying roller and to transmit the second driving force to the second conveying roller;

a detecting portion configured to detect a position of each of the first recording medium and the second recording medium; and a controller capable of controlling the recording portion, the first motor, the second motor, the power transmission mechanism, a conveyance of the first recording medium, and a conveyance of the second recording medium, the controller being configured to perform:

(a) conveying the first recording medium along the first conveying passage in the first conveying direction by (s1) rotating the first conveying roller and the second conveying roller, the (s1) rotating being performed by driving the first motor in the first state of the power transmission mechanism;

while performing the (a) conveying, (b) recording an image on one surface of the first recording medium using the recording portion;

after completion of the (b) recording, (c) determining using the detecting portion whether an upstream end of the first recording medium in the first conveying direction has been moved to the branching portion by the (a) conveying;

in response to determining, in the (c) determining, that the upstream end of the first recording medium in the first conveying direction has been moved to the branching portion by the (a) conveying, (d) switching the power transmission mechanism from the first state to the second state;

after the (d) switching, (e) conveying the first recording medium along the second conveying passage in the second conveying direction by (s2) rotating the second conveying roller, the (s2) rotating being performed by driving the second motor in the second state of the power transmission mechanism;

while performing the (e) conveying, (f) conveying the second recording medium along the first conveying passage in the first conveying direction by (s3) rotating the first conveying roller, the (s3) rotating being performed by driving the first motor in the second state of the power transmission mechanism;

after starting the (f) conveying, (g) recording an image on one surface of the second recording medium using the recording portion; and after completion of the (g) recording, (h) conveying the second recording medium along the second conveying passage in the second conveying direction.

2. The image recording apparatus according to claim 1, wherein the controller is configured to further perform:

after starting the (e) conveying, (i) determining using the detecting portion whether an upstream end of the first recording medium in the second conveying direction has been moved past the second conveying roller by the (e) conveying; and in response to determining, in the (i) determining, that the upstream end of the first recording medium in the second conveying direction has been moved past the second conveying roller by the (e) conveying, (j) switching the power transmission mechanism from the second state to the first state.

3. The image recording apparatus according to claim 2, further comprising:

a third conveying roller provided at the second conveying passage;

a follower roller provided so as to face the third conveying roller, the follower roller and the third conveying roller being configured to, in cooperation with each other, nip the first recording medium and the second recording medium; and a roller driver configured to rotate the third conveying roller, wherein the second conveying passage is longer than a length along the second conveying passage of the first recording medium, wherein the controller is configured to further perform:

after the (j) switching, (k) keeping the first recording medium waiting within the second conveying passage in a state where the first recording medium is nipped by the third conveying roller and the follower roller; and while performing the (k) keeping, (l) conveying the second recording medium along the first conveying passage in the first conveying direction by (s4) rotating the first conveying roller and the second conveying roller, the (s4) rotating being performed by driving the first motor in the first state of the power transmission mechanism, and wherein the (g) recording is performed while performing the (l) conveying.

4. The image recording apparatus according to claim 3, wherein the first conveying roller is positioned upstream of the recording portion in the first conveying direction, wherein, in the (a) conveying, the first conveying roller is rotated in a first rotational direction, wherein the controller is capable of further controlling the roller driver, the controller being configured to further perform:

after completion of the (g) recording, (m) determining using the detecting portion whether an upstream end of the second recording medium in the first conveying direction has been moved to the branching portion by the (l) conveying;

in response to determining, in the (m) determining, that the upstream end of the second recording medium in the first conveying direction has been moved to the branching portion by the (l) conveying, (n) switching the power transmission mechanism from the first state to the second state;

after the (n) switching, (o) keeping the second recording medium waiting in a state where the upstream end of the second recording medium in the first conveying direction is positioned at the branching portion, while performing the (o) keeping, (p) rotating the first conveying roller in a second rotational direction opposite to the first rotational direction, and while performing the (p) rotating, (q) conveying the first recording medium from the second conveying passage toward the first conveying passage through the joining portion to bring the first recording medium into abutment with the first conveying roller that is being rotated in the second rotational direction, and wherein the (q) conveying is performed by (s5) rotating the third conveying roller, the (s5) rotating being performed by driving the roller driver.

5. The image recording apparatus according to claim 1, further comprising:

a third motor;

an accommodation portion in which the first recording medium and the second recording medium are capable of being accommodated; and a supply roller configured to be rotated by the third motor, wherein the controller is capable of further controlling the third motor, the controller being configured to further perform:

within a time period from completion of the (b) recording until the upstream end of the first recording medium in the first conveying direction is moved to the branching portion by the (a) conveying, (r) conveying the second recording medium from the accommodation portion to the first conveying roller by (s6) rotating the supply roller, the (s6) rotating being performed by driving the third motor.

6. The image recording apparatus according to claim 1, wherein the power transmission mechanism is switched from the first state to the second state by rotating the second motor in a first rotational direction, and is switched from the second state to the first state by rotating the second motor in a second rotational direction opposite to the first rotational direction.

7. The image recording apparatus according to claim 6, wherein the power transmission mechanism comprises:

a first gear configured to be rotated by receiving the first driving force of the first motor, the first gear being movable between a first position and a second position, the first gear at the first position being capable of transmitting the first driving force to the second conveying roller, the first gear at the second position being unable to transmit the first driving force to the second conveying roller, the first gear moving from the first position to the second position by rotating the second motor in the first rotational direction, the first gear moving from the second position to the first position by rotating the second motor in the second rotational direction;

a transmission gear configured to be rotated by receiving the second driving force of the second motor; and a second gear in meshing engagement with the transmission gear, the second gear being configured to revolve around the transmission gear between a third position and a fourth position while rotating, the second gear at the third position being capable of transmitting the second driving force to the second conveying roller, the second gear at the fourth position being unable to transmit the second driving force to the second conveying roller, the second gear moving from the fourth position to the third position by rotating the second motor in the first rotational direction, the second gear moving from the third position to the fourth position by rotating the second motor in the second rotational direction.

8. The image recording apparatus according to claim 7, wherein the power transmission mechanism further comprises:

an abutted portion; and an abutting portion abutting on and moving the abutted portion by movement of the second gear from the fourth position to the third position, wherein the first gear is moved from the first position to the second position by the movement of the abutted portion.

9. The image recording apparatus according to claim 8, wherein the power transmission mechanism further comprises an urging member configured to urge the first gear in a direction from the second position toward the first position.

10. An image recording apparatus comprising:

a first conveying passage along which a first recording medium and a second recording medium are configured to be conveyed in a first conveying direction;

a recording portion provided at the first conveying passage, the recording portion being configured to record an image on each of the first recording medium and the second recording medium;

a second conveying passage branched from the first conveying passage at a branching portion and joining the first conveying passage at a joining portion, the branching portion being positioned downstream of the recording portion in the first conveying direction, the joining portion being positioned upstream of the recording portion in the first conveying direction, the first recording medium and the second recording medium being configured to be conveyed along the second conveying passage in a second conveying direction from the branching portion toward the joining portion;

a first conveying roller provided at the first conveying passage and positioned downstream of the joining portion in the first conveying direction;

a second conveying roller provided at the first conveying passage and positioned downstream of the branching portion in the first conveying direction;

a first motor configured to provide a first driving force;

a second motor configured to provide a second driving force;

a power transmission mechanism capable of being switched between a first state and a second state, the power transmission mechanism in the first state being configured to transmit the first driving force to both the first conveying roller and the second conveying roller, the power transmission mechanism in the second state being configured to transmit the first driving force to the first conveying roller and to transmit the second driving force to the second conveying roller;

a detecting portion configured to detect a position of each of the first recording medium and the second recording medium; and a controller capable of controlling the recording portion, the first motor, the second motor, and the power transmission mechanism, the controller being configured to perform:

(a) driving the first motor in the first state of the power transmission mechanism to rotate the first conveying roller and the second conveying roller, thereby conveying the first recording medium along the first conveying passage in the first conveying direction;

while performing the (a) driving, (b) recording an image on one surface of the first recording medium using the recording portion;

after completion of the (b) recording, (c) determining using the detecting portion whether an upstream end of the first recording medium in the first conveying direction has been moved to the branching portion by the (a) driving;

in response to determining, in the (c) determining, that the upstream end has been moved to the branching portion by the (a) driving, (d) switching the power transmission mechanism from the first state to the second state;

after the (d) switching, (e) driving the second motor in the second state of the power transmission mechanism to rotate the second conveying roller, thereby conveying the first recording medium along the second conveying passage in the second conveying direction;

while performing the (e) driving, (f) driving the first motor in the second state of the power transmission mechanism to rotate the first conveying roller, thereby conveying the second recording medium along the first conveying passage in the first conveying direction;

after starting the (f) driving, (g) recording an image on one surface of the second recording medium using the recording portion; and after completion of the (g) recording, (h) driving the second motor in the second state of the power transmission mechanism to rotate the second conveying roller, thereby conveying the second recording medium along the second conveying passage in the second conveying direction.

* * * * *